US007179201B2

(12) United States Patent
Rodgers, Jr.

(10) Patent No.: US 7,179,201 B2
(45) **Date of Patent: *Feb. 20, 2007**

(54) VARIABLE STRIDE EXERCISE APPARATUS

(76) Inventor: Robert E. Rodgers, Jr., 974 Kings Point Dr., Canyon Lake, TX (US) 78133

( * ) Notice: Subject to any disclaimer, the term of this patent is extended or adjusted under 35 U.S.C. 154(b) by 221 days.

This patent is subject to a terminal disclaimer.

(21) Appl. No.: 10/862,291

(22) Filed: Jun. 7, 2004

(65) Prior Publication Data

US 2004/0248708 A1 Dec. 9, 2004

Related U.S. Application Data

(63) Continuation of application No. 10/723,734, filed on Nov. 26, 2003.

(60) Provisional application No. 60/476,548, filed on Jun. 6, 2003, provisional application No. 60/486,333, filed on Jul. 11, 2003, provisional application No. 60/490,154, filed on Jul. 25, 2003, provisional application No. 60/491,382, filed on Jul. 31, 2003, provisional application No. 60/494,308, filed on Aug. 11, 2003, provisional application No. 60/503,905, filed on Sep. 19, 2003, provisional application No. 60/511,190, filed on Oct. 14, 2003, provisional application No. 60/515,238, filed on Oct. 29, 2003.

(51) Int. Cl.
*A63B 22/04* (2006.01)
*A63B 69/16* (2006.01)

(52) U.S. Cl. ..... 482/52; 482/57

(58) Field of Classification Search ..... 482/51, 482/52, 57, 70, 79–80
See application file for complete search history.

(56) References Cited

U.S. PATENT DOCUMENTS

| | | | |
|---|---|---|---|
| 219,439 | A | 9/1879 | Blend |
| 326,247 | A | 9/1885 | Root |
| 964,898 | A | 7/1910 | Budingen |
| 1,166,304 | A | 12/1915 | Albert |

(Continued)

FOREIGN PATENT DOCUMENTS

| | | |
|---|---|---|
| DE | 2919494 | 11/1980 |

(Continued)

OTHER PUBLICATIONS inshape, "A fitness machine for all reasons", relating to Precor C544, 1 page, undated.

(Continued)

*Primary Examiner*—Stephen R. Crow
(74) *Attorney, Agent, or Firm*—Fulbright & Jaworski LLP

(57) ABSTRACT

A variable stride exercise apparatus is described. The apparatus may include a frame. A crank system may be coupled to the frame. In certain embodiments, arm links may be coupled to the frame. The apparatus may include foot members that travel in multiple paths. The foot members may include footpads. The foot members may be coupled to the arm links. The foot members may be coupled to the crank system through cam devices. The variable stride systems may be coupled to the foot members such that at least a portion of the variable stride system is under at least a portion of the footpad. The foot members may be cross coupled so that the left foot member moves in opposition to the right foot member.

41 Claims, 26 Drawing Sheets

U.S. PATENT DOCUMENTS

| | | | |
|---|---|---|---|
| 1,899,255 | A | 2/1933 | Bell |
| 2,369,934 | A | 2/1945 | Aupperle |
| 2,603,486 | A | 7/1952 | Hughes |
| 2,969,060 | A | 1/1961 | Swanda |
| 3,316,898 | A | 5/1967 | Brown |
| 3,316,899 | A | 5/1967 | Raeder |
| 3,432,164 | A | 3/1969 | Deeks |
| 3,563,541 | A | 2/1971 | Sanquist |
| 3,578,800 | A | 5/1971 | DiNepi |
| 3,592,466 | A | 7/1971 | Parsons |
| 3,638,940 | A | 2/1972 | Mehaulic |
| 3,704,886 | A | 12/1972 | Kay et al. |
| 3,711,812 | A | 1/1973 | Cherry |
| 3,741,538 | A | 6/1973 | Lewis et al. |
| 3,747,924 | A | 7/1973 | Champoux |
| 3,756,595 | A | 9/1973 | Hague |
| 3,759,511 | A | 9/1973 | Zinkin et al. |
| 3,824,994 | A | 7/1974 | Soderberg, Sr. |
| 3,826,491 | A | 7/1974 | Elder |
| 3,941,377 | A | 3/1976 | Lie |
| 3,970,302 | A | 7/1976 | McFee |
| 3,995,491 | A | 12/1976 | Wolfa, II |
| 4,053,173 | A | 10/1977 | Chase, Sr. |
| 4,185,622 | A | 1/1980 | Swenson |
| 4,188,030 | A | 2/1980 | Hooper |
| 4,379,566 | A | 4/1983 | Titcomb |
| 4,456,276 | A | 6/1984 | Bortolin |
| 4,470,597 | A | 9/1984 | McFee |
| 4,477,072 | A | 10/1984 | DeCloux |
| 4,509,742 | A | 4/1985 | Cones |
| 4,555,109 | A | 11/1985 | Hartmann |
| 4,561,318 | A | 12/1985 | Schirrmacher |
| 4,632,385 | A | 12/1986 | Geraci |
| 4,645,200 | A | 2/1987 | Hix |
| 4,645,201 | A | 2/1987 | Evans |
| 4,679,786 | A | 7/1987 | Rodgers, Jr. |
| 4,684,121 | A | 8/1987 | Nestegard |
| 4,720,093 | A | 1/1988 | Del Mar |
| 4,786,050 | A | 11/1988 | Geschwender |
| 4,842,268 | A | 6/1989 | Jenkins |
| 4,846,461 | A | 7/1989 | Robards, Jr. et al. |
| 4,869,494 | A | 9/1989 | Lambert, Sr. |
| 4,900,013 | A | 2/1990 | Rodgers, Jr. |
| 4,936,570 | A | 6/1990 | Szymski et al. |
| 4,940,233 | A | 7/1990 | Bull et al. |
| 4,949,954 | A | 8/1990 | Hix |
| 4,949,993 | A | 8/1990 | Stark et al. |
| 4,951,937 | A | 8/1990 | Hoffenberg et al. |
| 4,955,600 | A | 9/1990 | Hoffenberg et al. |
| 4,976,424 | A | 12/1990 | Sargeant et al. |
| 4,989,857 | A | 2/1991 | Kuo |
| 5,000,443 | A | 3/1991 | Dalebout et al. |
| 5,039,087 | A | 8/1991 | Kuo |
| 5,039,088 | A | 8/1991 | Shifferaw |
| 5,046,723 | A | 9/1991 | Szymski et al. |
| 5,050,864 | A | 9/1991 | Pertramer |
| 5,078,389 | A | 1/1992 | Chen |
| 5,094,449 | A | 3/1992 | Stearns |
| 5,094,450 | A | 3/1992 | Stearns |
| 5,131,895 | A | 7/1992 | Rodgers, Jr. |
| 5,135,447 | A | 8/1992 | Robards, Jr. et al. |
| 5,163,888 | A | 11/1992 | Stearns |
| 5,186,697 | A | 2/1993 | Rennex |
| 5,192,257 | A | 3/1993 | Panasewicz |
| 5,203,826 | A | 4/1993 | Dalebout |
| 5,211,613 | A | 5/1993 | Friesl |
| 5,230,677 | A | 7/1993 | Chi |
| 5,242,343 | A | 9/1993 | Miller |
| 5,247,853 | A | 9/1993 | Dalebout |
| 5,279,529 | A | 1/1994 | Eschenbach |
| 5,290,205 | A | 3/1994 | Densmore et al. |
| 5,290,211 | A | 3/1994 | Stearns |
| 5,295,928 | A | 3/1994 | Rennex |
| 5,299,993 | A | 4/1994 | Habing |
| 5,328,427 | A | 7/1994 | Sleamaker |
| 5,336,141 | A | 8/1994 | Vittone |
| 5,336,143 | A | 8/1994 | Wu |
| 5,336,146 | A | 8/1994 | Piaget et al. |
| 5,346,447 | A | 9/1994 | Stearns |
| 5,352,169 | A | 10/1994 | Eschenbach |
| 5,383,829 | A | 1/1995 | Miller |
| 5,387,167 | A | 2/1995 | Johnston |
| 5,401,226 | A | 3/1995 | Stearns |
| 5,403,255 | A | 4/1995 | Johnston |
| 5,419,747 | A | 5/1995 | Piaget et al. |
| 5,423,729 | A | 6/1995 | Eschenbach |
| 5,489,250 | A | 2/1996 | Densmore et al. |
| 5,496,235 | A | 3/1996 | Stevens |
| 5,499,956 | A | 3/1996 | Habing |
| 5,518,473 | A | 5/1996 | Miller |
| 5,527,246 | A | 6/1996 | Rodgers, Jr. |
| 5,529,554 | A | 6/1996 | Eschenbach |
| 5,529,555 | A | 6/1996 | Rodgers, Jr. |
| 5,536,224 | A | 7/1996 | Hsieh |
| 5,540,637 | A | 7/1996 | Rodgers, Jr. |
| 5,545,112 | A | 8/1996 | Densmore et al. |
| 5,549,526 | A | 8/1996 | Rodgers, Jr. |
| 5,562,574 | A | 10/1996 | Miller |
| 5,573,480 | A | 11/1996 | Rodgers, Jr. |
| 5,577,985 | A | 11/1996 | Miller |
| 5,584,781 | A | 12/1996 | Chen |
| 5,591,107 | A | 1/1997 | Rodgers, Jr. |
| 5,593,371 | A | 1/1997 | Rodgers, Jr. |
| 5,593,372 | A | 1/1997 | Rodgers, Jr. |
| 5,595,553 | A | 1/1997 | Rodgers, Jr. |
| 5,595,554 | A | 1/1997 | Maresh |
| 5,595,555 | A | 1/1997 | Chen |
| 5,605,521 | A | 2/1997 | Hsieh |
| 5,611,756 | A | 3/1997 | Miller |
| 5,611,757 | A | 3/1997 | Rodgers, Jr. |
| 5,611,758 | A | 3/1997 | Rodgers, Jr. |
| 5,613,924 | A | 3/1997 | Lee |
| 5,616,103 | A | 4/1997 | Lee |
| 5,624,354 | A | 4/1997 | Chen |
| 5,626,539 | A | 5/1997 | Piaget et al. |
| 5,637,058 | A | 6/1997 | Rodgers, Jr. |
| 5,643,140 | A | 7/1997 | Tsai |
| 5,653,662 | A | 8/1997 | Rodgers, Jr. |
| 5,655,998 | A | 8/1997 | Yu |
| 5,658,223 | A | 8/1997 | Habing et al. |
| 5,658,227 | A | 8/1997 | Stearns |
| 5,669,856 | A | 9/1997 | Liu |
| 5,683,333 | A | 11/1997 | Rodgers, Jr. |
| 5,685,804 | A | 11/1997 | Whan-Tong et al. |
| 5,690,589 | A | 11/1997 | Rodgers, Jr. |
| 5,692,994 | A | 12/1997 | Eschenbach |
| 5,692,997 | A | 12/1997 | Stearns |
| 5,707,321 | A | 1/1998 | Maresh |
| 5,708,060 | A | 1/1998 | Sands et al. |
| 5,709,632 | A | 1/1998 | Socwell |
| 5,720,698 | A | 2/1998 | Dalebout et al. |
| 5,725,457 | A | 3/1998 | Maresh |
| 5,733,227 | A | 3/1998 | Lee |
| 5,735,773 | A | 4/1998 | Vittone |
| 5,735,774 | A | 4/1998 | Maresh |
| 5,738,614 | A | 4/1998 | Rodgers, Jr. |
| 5,743,834 | A | 4/1998 | Rodgers, Jr. |
| 5,755,642 | A | 5/1998 | Miller |
| 5,755,645 | A | 5/1998 | Miller et al. |
| 5,759,135 | A | 6/1998 | Chen |
| 5,759,136 | A | 6/1998 | Chen |
| 5,762,588 | A | 6/1998 | Chen |
| 5,766,113 | A | 6/1998 | Rodgers, Jr. |
| 5,769,760 | A | 6/1998 | Lin |

5,772,558 A 6/1998 Rodgers, Jr.
5,779,598 A 7/1998 Lee
5,779,599 A 7/1998 Chen
5,788,609 A 8/1998 Miller
5,788,610 A 8/1998 Eschenbach
5,792,026 A 8/1998 Maresh et al.
5,792,027 A 8/1998 Gvoich
5,792,028 A 8/1998 Jarvie
5,792,029 A 8/1998 Gordon
5,795,268 A 8/1998 Husted
5,803,871 A 9/1998 Stearns et al.
5,803,872 A 9/1998 Chang
5,813,949 A 9/1998 Rodgers, Jr.
5,823,919 A 10/1998 Eschenbach
5,833,584 A 11/1998 Piaget et al.
5,836,854 A 11/1998 Kuo
5,836,855 A 11/1998 Eschenbach
5,848,954 A 12/1998 Stearns et al.
5,857,941 A 1/1999 Maresh et al.
5,865,712 A 2/1999 Chang
5,876,307 A 3/1999 Stearns et al.
5,879,271 A 3/1999 Stearns et al.
5,882,281 A 3/1999 Stearns et al.
D408,477 S 4/1999 Arnold
5,893,820 A 4/1999 Maresh et al.
5,895,339 A 4/1999 Maresh
5,897,463 A 4/1999 Maresh
5,899,833 A 5/1999 Ryan et al.
5,908,373 A 6/1999 Pitre
5,910,072 A 6/1999 Rawls et al.
5,911,649 A 6/1999 Miller
5,913,751 A 6/1999 Eschenbach
5,916,064 A 6/1999 Eschenbach
5,916,065 A 6/1999 McBride et al.
5,919,118 A 7/1999 Stearns et al.
5,921,894 A 7/1999 Eschenbach
5,924,962 A 7/1999 Rodgers, Jr.
5,924,963 A 7/1999 Maresh et al.
5,935,046 A 8/1999 Maresh
5,938,567 A 8/1999 Rodgers, Jr.
5,938,568 A 8/1999 Maresh et al.
5,938,570 A 8/1999 Maresh
5,938,575 A 8/1999 Stearns
5,944,638 A 8/1999 Maresh et al.
5,947,872 A 9/1999 Ryan et al.
5,957,814 A 9/1999 Eschenbach
5,964,682 A 10/1999 Sokol
5,967,944 A 10/1999 Vittone et al.
5,971,892 A 10/1999 Lee
5,989,163 A 11/1999 Rodgers, Jr.
5,993,359 A 11/1999 Eschenbach
5,997,445 A 12/1999 Maresh et al.
5,997,446 A 12/1999 Stearns
6,004,244 A 12/1999 Simonson
6,017,294 A 1/2000 Eschenbach
6,019,710 A 2/2000 Dalebout et al.
6,024,676 A 2/2000 Eschenbach
6,027,430 A 2/2000 Stearns et al.
6,027,431 A 2/2000 Stearns et al.
6,030,320 A 2/2000 Stearns et al.
6,036,622 A 3/2000 Gordon
6,042,510 A 3/2000 Miller
6,042,512 A 3/2000 Eschenbach
6,045,487 A 4/2000 Miller
6,045,488 A 4/2000 Eschenbach
6,053,847 A 4/2000 Stearns et al.
6,063,009 A 5/2000 Stearns et al.
6,066,073 A 5/2000 Stearns et al.
6,077,196 A 6/2000 Eschenbach
6,077,197 A 6/2000 Stearns et al.
6,077,198 A 6/2000 Eschenbach
6,080,086 A 6/2000 Maresh et al.
6,083,143 A 7/2000 Maresh
6,090,013 A 7/2000 Eschenbach
6,090,014 A 7/2000 Eschenbach
6,099,439 A 8/2000 Ryan et al.
6,113,518 A 9/2000 Maresh et al.
6,117,052 A 9/2000 Frost et al.
6,123,650 A 9/2000 Birrell
6,126,573 A 10/2000 Eschenbach
6,126,574 A 10/2000 Stearns et al.
6,135,923 A 10/2000 Stearns et al.
6,142,915 A 11/2000 Eschenbach
6,146,313 A 11/2000 Whan-Tong et al.
6,149,551 A 11/2000 Pyles
6,152,859 A 11/2000 Stearns
6,165,107 A 12/2000 Birrell
6,168,552 B1 1/2001 Eschenbach
6,171,215 B1 1/2001 Stearns et al.
6,171,217 B1 1/2001 Cutler
6,176,814 B1 1/2001 Ryan et al.
6,183,397 B1 2/2001 Stearns et al.
6,183,398 B1 2/2001 Rufino et al.
6,190,289 B1 2/2001 Pyles et al.
6,196,948 B1 3/2001 Stearns et al.
6,206,804 B1 3/2001 Maresh
6,206,806 B1 3/2001 Chu
6,206,809 B1 3/2001 Habing et al.
6,210,305 B1 4/2001 Eschenbach
6,217,485 B1 4/2001 Maresh
6,217,486 B1 4/2001 Rosenow
6,248,044 B1 6/2001 Stearns et al.
6,248,045 B1 6/2001 Stearns et al.
6,248,046 B1 6/2001 Maresh et al.
6,251,047 B1 6/2001 Stearns et al.
6,254,514 B1 7/2001 Maresh et al.
6,283,895 B1 9/2001 Stearns et al.
6,302,825 B1 10/2001 Stearns et al.
6,302,830 B1 10/2001 Stearns
6,302,832 B1 10/2001 Stearns
6,312,362 B1 11/2001 Maresh et al.
6,338,698 B1 1/2002 Stearns et al.
6,340,340 B1 1/2002 Stearns et al.
6,361,476 B1 3/2002 Eschenbach
6,368,252 B1 4/2002 Stearns
6,379,285 B1 4/2002 Maresh et al.
6,387,017 B1 5/2002 Maresh
6,390,953 B1 5/2002 Maresh et al.
6,398,695 B2 6/2002 Miller
6,409,632 B1 6/2002 Eschenbach
6,409,635 B1 6/2002 Maresh et al.
6,416,442 B1 7/2002 Stearns et al.
6,419,613 B2 7/2002 Stearns et al.
6,422,976 B1 7/2002 Eschenbach
6,422,977 B1 7/2002 Eschenbach
6,436,007 B1 8/2002 Eschenbach
6,440,042 B2 8/2002 Eschenbach
6,461,277 B2 10/2002 Maresh et al.
6,461,279 B1 10/2002 Kuo
6,482,132 B2 11/2002 Eschenbach
6,485,395 B1 11/2002 Stearns et al.
6,500,096 B1 12/2002 Farney
6,527,677 B2 3/2003 Maresh
6,527,680 B1 3/2003 Maresh
6,540,646 B2 4/2003 Stearns et al.
6,544,146 B1 4/2003 Stearns et al.
6,547,701 B1 4/2003 Eschenbach
6,551,218 B2 4/2003 Goh
6,554,750 B2 4/2003 Stearns et al.
6,565,486 B2 5/2003 Stearns et al.
6,569,061 B2 5/2003 Stearns et al.
6,569,062 B2 5/2003 Wang et al.
6,579,210 B1 6/2003 Stearns et al.
6,612,969 B2 9/2003 Eschenbach
6,626,802 B1 9/2003 Rodgers, Jr.
6,629,909 B1 10/2003 Stearns et al.

| | | | |
|---|---|---|---|
| 6,645,125 | B1 | 11/2003 | Stearns et al. |
| 6,648,800 | B2 | 11/2003 | Stearns et al. |
| 6,648,801 | B2 | 11/2003 | Stearns et al. |
| 6,672,994 | B1 | 1/2004 | Stearns et al. |
| 6,689,019 | B2 | 2/2004 | Ohrt et al. |
| 6,689,020 | B2 | 2/2004 | Stearns et al. |
| 6,695,581 | B2 | 2/2004 | Wasson et al. |
| D489,101 | S | 4/2004 | Giannelli et al. |
| 6,719,666 | B1 | 4/2004 | Lo et al. |
| 6,761,665 | B2 | 7/2004 | Nguyen |
| 6,811,517 | B1 | 11/2004 | Eschenbach |
| 6,835,166 | B1 | 12/2004 | Stearns |
| 6,837,829 | B2 | 1/2005 | Eschenbach |
| 6,875,160 | B2 | 4/2005 | Watterson et al. |
| 2001/0001304 | A1 | 5/2001 | Maresh et al. |
| 2001/0001305 | A1 | 5/2001 | Stearns et al. |
| 2001/0004623 | A1 | 6/2001 | Miller |
| 2001/0011053 | A1 | 8/2001 | Miller |
| 2001/0016541 | A1 | 8/2001 | Maresh et al. |
| 2001/0031685 | A1 | 10/2001 | Maresh |
| 2001/0036886 | A1 | 11/2001 | Eschenbach |
| 2001/0051562 | A1 | 12/2001 | Stearns et al. |
| 2001/0056010 | A1 | 12/2001 | Stearns et al. |
| 2002/0019298 | A1 | 2/2002 | Eschenbach |
| 2002/0028731 | A1 | 3/2002 | Stearns et al. |
| 2002/0055420 | A1 | 5/2002 | Stearns et al. |
| 2002/0082146 | A1 | 6/2002 | Stearns |
| 2002/0094914 | A1 | 7/2002 | Maresh et al. |
| 2002/0119867 | A1 | 8/2002 | Stearns et al. |
| 2002/0123411 | A1 | 9/2002 | Stearns et al. |
| 2002/0128122 | A1 | 9/2002 | Miller |
| 2002/0142890 | A1 | 10/2002 | Orht et al. |
| 2002/0151411 | A1 | 10/2002 | Stearns et al. |
| 2002/0165066 | A1 | 11/2002 | Stearns |
| 2002/0173412 | A1 | 11/2002 | Stearns |
| 2002/0198083 | A1 | 12/2002 | Goh |
| 2002/0198084 | A1 | 12/2002 | Stearns et al. |
| 2003/0022763 | A1 | 1/2003 | Ryan et al. |
| 2003/0022771 | A1 | 1/2003 | Stearns |
| 2003/0027690 | A1 | 2/2003 | Miller |
| 2003/0040404 | A1 | 2/2003 | Maresh |
| 2003/0092532 | A1 | 5/2003 | Giannelli et al. |
| 2003/0096677 | A1 | 5/2003 | Chu |
| 2003/0166434 | A1 | 9/2003 | Lopez-Santillana et al. |
| 2004/0005960 | A1 | 1/2004 | Chang |
| 2004/0058784 | A1 | 3/2004 | Rodgers, Jr. |
| 2004/0077463 | A1 | 4/2004 | Rodgers, Jr. |
| 2004/0097339 | A1 | 5/2004 | Moon |
| 2004/0132583 | A1 | 7/2004 | Ohrt et al. |
| 2004/0147375 | A1 | 7/2004 | Stevens |
| 2004/0162191 | A1 | 8/2004 | Ercanbrack et al. |
| 2004/0192514 | A1 | 9/2004 | Piaget et al. |
| 2004/0209741 | A1 | 10/2004 | Kuo |
| 2004/0214693 | A1 | 10/2004 | Piaget et al. |
| 2004/0248704 | A1 | 12/2004 | Rodgers, Jr. |
| 2004/0248705 | A1 | 12/2004 | Rodgers, Jr. |
| 2004/0248707 | A1 | 12/2004 | Rodgers, Jr. |
| 2004/0248708 | A1 | 12/2004 | Rodgers, Jr. |
| 2004/0248709 | A1 | 12/2004 | Rodgers, Jr. |
| 2004/0248710 | A1 | 12/2004 | Rodgers, Jr. |
| 2004/0248711 | A1 | 12/2004 | Rodgers, Jr. |
| 2005/0026752 | A1 | 2/2005 | Lull et al. |
| 2005/0037898 | A1 | 2/2005 | Chang |
| 2005/0043145 | A1 | 2/2005 | Anderson et al. |
| 2005/0049117 | A1 | 3/2005 | Rodgers, Jr. |
| 2005/0049120 | A1 | 3/2005 | Maresh |
| 2005/0202939 | A1 | 9/2005 | Lull et al. |
| 2005/0209059 | A1 | 9/2005 | Crawford et al. |
| 2005/0209060 | A1 | 9/2005 | Lull |
| 2005/0209061 | A1 | 9/2005 | Crawford et al. |
| 2005/0233864 | A1 | 10/2005 | Smith et al. |
| 2006/0003868 | A1 | 1/2006 | Lull et al. |

FOREIGN PATENT DOCUMENTS

| | | |
|---|---|---|
| EP | 914842 | 5/1999 |
| GB | 497817 | 12/1938 |
| WO | 95/16502 | 6/1995 |
| WO | 96/22814 | 8/1996 |
| WO | 97/45170 | 12/1997 |

OTHER PUBLICATIONS

"New Cardio Machines: Good for the Heart and Mind", Noah Liberman, HG&F, relates to Precor C544 Transport, 1 page, undated.

Health and Fitness, "Get Elliptical", 1 page, undated, but before mid-1996.

Profiles in Quality, "Precor: Work Out Smarter", Club Industry, 1 page, approx. 1995.

Home Gym and Fitness, "Inside Sports", 1 page, Spring 1996.

Health & Fitness Business Buyer's Guide, "Commercial Market In Store for Surprise", 2 pages, Fall 1996.

Home Gym and Fitness, Inside Sports, "The New Cardio Machines Easy on the Body, Good for the Heart", 2 pages, Winter 1996.

"Diet Wars The fads/the facts", SHAPE, 1 page, Feb. 1996.

Article from Delaware State News, "Newest fitness stuff goes on display", Marilynn Preston, 1 page, Jul. 31, 1996.

North Coast Sports, vol. 3, Issue 8, 1 page, Sep. 1996.

Sporting Goods, Machine Design, Oct. 10, 1996.

Men's Fitness, "It's a stairmill . . . It's a treadclimber . . . It's an EFX", 2 pages, Nov. 1996.

Fitness Product News, "Zero Impact Exercise", 2 pages, Nov./Dec. 1996.

Article from Poughkeepsie Journal, "Fitness machine flurry can be confusing", Allision Simmons, 1 page, Jan. 16, 1997.

Health & Fitness, "Less Pain for the Gain", 1 page, Feb. 24, 1997.

"one mean machine" relating to Precor Elliptical trainers, SHAPE, 1 page, Mar. 1997.

Bacon's, "Spin to it!", "Fitness: New exercise machines that employ elliptical movements are a hot item at health clubs", 1 page, Jun. 4, 1997.

Time digital, "How best to break a HIGH-TECH sweat?", relates to Precor EFX, 1 page, Jul./Aug. 1997.

Cincinnati Enquirer, "Elliptical cross-trainers, outpacing traditional climbers", Aug. 20, 1997.

The San Diego Union-Tribune, "New machines prove popular with gym rats", 1 page, Nov. 5, 1997.

Health & Fitness Business Buyer's Guide, Cardiovascular, "Changing of the Guard", 2 pages, Jun. 1999.

"Schwinn Fitness Harness the Force of Nature and You Possess the Strength of Confidence", Schwinn, Cycling & Fitness, Inc., catalog, 30 pages, 1996.

"Nautilus Home Health & Fitness Catalog", Nautilus, Inc. pp. 1-56 (2004).

Provisional Patent Application entitled "Variable Stride Exercise Device", Express Mail No. EV156971344US, 16 pages.

Provisional Patent Application entitled "Variable Stride Exercise Device" to Lull et al., Express Mail No. EV423770351US, 59 pages.

Claim set from co-pending U.S. Appl. No. 11/005,576; 11 pages.

Claim set from co-pending U.S. Appl. No. 11/005,223; 20 pages.

International Search Report for PCT Application No. PCT/US2004/018176 mailed Nov. 5, 2004.

Written Opinion of International Searching Authority for PCT. Application No. PCT/US2004/018176 mailed Nov. 5, 2004.

International Search Report for PCT Application No. PCT/US2004/018177 mailed Nov. 5, 2004.

Written Opinion of International Searching Authority for PCT. Application No. PCT/US2004/018177 mailed Nov. 5, 2004.
Press Release from 2004 Health & Business Expo and Conference in Denver, CO Clubmarket.com web page (Sep. 2004).
Nautilus Pro Series Ellipticals Product Brochure obtained by Bob Rodgers from 2004 Health & Business Expo and Conference in Denver, CO (Aug. 2004).
805/807 Elliptical Trainer Brochure, SportsArt company web page (Nov. 2003).
Schwinn Original Airdyne, Schwinn company web page (Apr. 2001).
SCIFIT SX1000, SCIFIT company web page (Jan. 2001).
SCIFIT SX1000, SX7000, SXT7000, SCIFIT company web page (Jun. 2002).

VARIABLE STRIDE EXERCISE APPARATUS

PRIORITY CLAIM

This application is a continuation of U.S. patent application Ser. No. 10/723,734 entitled "Variable Stride Exercise Apparatus" to Robert E. Rodgers, Jr., filed on Nov. 26, 2003, which claims the benefits of: U.S. Provisional Patent Application No. 60/476,548 entitled "Variable Stride Elliptic Exercise Device" to Robert E. Rodgers, Jr., filed on Jun. 6, 2003; U.S. Provisional Patent Application No. 60/486,333 entitled "Variable Stride Exercise Device" to Robert E. Rodgers, Jr., filed on Jul. 11, 2003; U.S. Provisional Patent Application No. 60/490,154 entitled "Variable Stride Exercise Device" to Robert E. Rodgers, Jr., filed on Jul. 25, 2003; U.S. Provisional Patent Application No. 60/491,382 entitled "Variable Stride Exercise Device" to Robert E. Rodgers, Jr., filed on Jul. 31, 2003; U.S. Provisional Patent Application No. 60/494,308 entitled "Variable Stride Exercise Device" to Robert E. Rodgers, Jr., filed on Aug. 11, 2003; U.S. Provisional Patent Application No. 60/503,905 entitled "Variable Stride Exercise Device" to Robert E. Rodgers, Jr., filed on Sep. 19, 2003; U.S. Provisional Patent Application No. 60/511,190 entitled "Variable Stride Apparatus" to Robert E. Rodgers, Jr., filed on Oct. 14, 2003; and U.S. Provisional Patent Application No. 60/515,238 entitled "Variable Stride Exercise Device" to Robert E. Rodgers, Jr., filed on Oct. 29, 2003.

BACKGROUND

1. Field of the Invention

The present invention relates generally to an exercise apparatus. Certain embodiments relate to variable motion exercise apparatus that may allow exercise such as simulated climbing, walking, striding, and/or jogging.

2. Description of Related Art

Exercise devices have been in use for years. Some typical exercise devices that simulate walking or jogging include cross country ski machines, elliptical motion machines, and pendulum motion machines.

Elliptical motion exercise apparatus in many cases provide inertia that assists in direction change of the pedals, making the exercise smooth and comfortable (e.g., see U.S. Pat. No. 5,242,343 to Miller; U.S. Pat. No. 5,383,829 to Miller; U.S. Pat. No. 5,518,473 to Miller; U.S. Pat. No. 5,755,642 to Miller; U.S. Pat. No. 5,577,985 to Miller; U.S. Pat. No. 5,611,756 to Miller; U.S. Pat. No. 5,911,649 to Miller; 6,045,487 to Miller; U.S. Pat. No. 6,398,695 to Miller; U.S. Pat. No. 5,913,751 to Eschenbach; U.S. Pat. No. 5,916,064 to Eschenbach; U.S. Pat. No. 5,921,894 to Eschenbach; U.S. Pat. No. 5,993,359 to Eschenbach; U.S. Pat. No. 6,024,676 to Eschenbach; U.S. Pat. No. 6,042,512 to Eschenbach; U.S. Pat. No. 6,045,488 to Eschenbach; U.S. Pat. No. 6,077,196 to Eschenbach; U.S. Pat. No. 6,077,198 to Eschenbach; U.S. Pat. No. 6,090,013 to Eschenbach; U.S. Pat. No. 6,090,014 to Eschenbach; U.S. Pat. No. 6,142,915 to Eschenbach; U.S. Pat. No. 6,168,552 to Eschenbach; U.S. Pat. No. 6,210,305 to Eschenbach; U.S. Pat. No. 6,361,476 to Eschenbach; U.S. Pat. No. 6,409,632 to Eschenbach; U.S. Pat. No. 6,422,976 to Eschenbach; U.S. Pat. No. 6,422,977 to Eschenbach; U.S. Pat. No. 6,436,007 to Eschenbach; U.S. Pat. No. 6,440,042 to Eschenbach; U.S. Pat. No. 6,482,132 to Eschenbach; and U.S. Pat. No. 6,612,969 to Eschenbach).

Elliptical motion exercise apparatus are also described in U.S. Pat. No. 5,573,480 to Rodgers, Jr.; U.S. Pat. No. 5,683,333 to Rodgers, Jr.; U.S. Pat. No. 5,738,614 to Rodgers, Jr.; U.S. Pat. No. 5,924,962 to Rodgers, Jr.; U.S. Pat. No. 5,938,567 to Rodgers, Jr.; U.S. Pat. No. 5,549,526 to Rodgers, Jr.; U.S. Pat. No. 5,593,371 to Rodgers, Jr.; U.S. Pat. No. 5,595,553 to Rodgers, Jr.; U.S. Pat. No. 5,637,058 to Rodgers, Jr.; U.S. Pat. No. 5,772,558 to Rodgers, Jr.; U.S. Pat. No. 5,540,637 to Rodgers, Jr.; U.S. Pat. No. 5,593,372 to Rodgers, Jr.; U.S. Pat. No. 5,766,113 to Rodgers, Jr.; and U.S. Pat. No. 5,813,949 to Rodgers, Jr.; U.S. Pat. No. 5,690,589 to Rodgers, Jr.; U.S. Pat. No. 5,743,834 to Rodgers, Jr.; U.S. Pat. No. 5,611,758 to Rodgers, Jr.; U.S. Pat. No. 5,653,662 to Rodgers, Jr.; and U.S. Pat. No. 5,989,163 to Rodgers, Jr., each of which is incorporated by reference as if fully set forth herein.

In many exercise apparatus, rigid coupling to a crank generally confines the elliptical path to a fixed stride or path length. The fixed elliptical path length may either be too long for shorter users or too short for taller users.

Adjustable stride elliptical exercise apparatus have been disclosed in previous patents (e.g., U.S. Pat. No. 5,743,834 to Rodgers, Jr.). Although some of these exercise apparatus have addressed the issue of a fixed path length, the stride adjustment is made through changes or adjustments to the crank geometry. Mechanisms for adjustment in such apparatus may add significant cost, may require input by a user to a control system, and/or may not react relatively quickly to user input.

Pivoting foot pedal systems have been disclosed in previous patents (e.g., U.S. Pat. No. 5,690,589 to Rodgers, Jr.). Pivoting foot pedal systems may be configured such that the pivotal connection to the pedal is located above the pedal surface and a pendulum action may occur during pedal pivoting. This pendulum action may slightly increase the stride length. Such increases in stride length, however, are generally a small percentage of stride length and are not generally perceived by a user of the apparatus.

Published U.S. Pat. Appl. No. 2002/0142890 to Ohrt et al., which is incorporated by reference as if fully set forth herein, discloses a user defined, dynamically variable stride exercise apparatus. A crank based system with a link that engages a roller at the end of a crank is disclosed. The link may have springs or cams to control and limit stride length. The cams, however, are placed away from the user and directly engage the crank. The resultant forces created by the cam are limited because the full weight of the user may not be applied to the cam. A housing to cover the crank and cam system may be large, thus adding to manufacturing cost. In addition, the overall length of the system may be relatively high. The foot/ankle articulation patterns are determined by the angular motion of the links engaging the crank, which may not desirable for all users of the system.

SUMMARY

In certain embodiments, a variable stride exercise apparatus may provide a variable range of motion controlled by a user of the apparatus. In an embodiment, an exercise apparatus may include a frame. A crank system may be coupled to the frame. A pivotal linkage assembly may be coupled to the crank system. In certain embodiments, a pivotal linkage assembly may include a foot member and/or an arm link. The foot member may include or be coupled to a footpad. In some embodiments, a movable member may be coupled to the pivotal linkage assembly or be a part of the pivotal linkage assembly. The movable member may be coupled to the crank system. In certain embodiments, the apparatus may be designed such that the foot of the user can travel in a substantially closed path during use of the apparatus. In some embodiments, the apparatus may be designed such that the foot of the user can travel in a curvilinear path during use of the apparatus. In some embodiments, the apparatus may be designed such that the foot of the user can travel in a relatively linear path during use of the apparatus.

In certain embodiments, a variable stride system may be coupled to the pivotal linkage assembly. In some embodiments, a variable stride system may include a cam device. In certain embodiments, a variable stride system may include a spring device and/or a damper device. A variable stride system may be coupled to a foot member and/or a movable member. In certain embodiments, the foot member may be coupled to the movable member through the variable stride system. The variable stride system may allow a user of the apparatus to vary the length of the user's stride during use of the apparatus. Varying the length of the user's stride may allow a user to selectively vary the path of the user's foot (e.g., by varying the path of the foot member or footpad).

In certain embodiments, an exercise apparatus has a maximum stride length that is at least about 40% of an overall length of the apparatus. In some embodiments, a variable stride system may be coupled to a foot member within about 24 inches of an end of a footpad. In certain embodiments, the variable stride system may be coupled to the foot member such that at least a portion of the variable stride system is located under at least a portion of the footpad. In some embodiments, the variable stride system may be coupled to the foot member at a location between the footpad and the crank system.

BRIEF DESCRIPTION OF THE DRAWINGS

Advantages of the present invention may become apparent to those skilled in the art with the benefit of the following detailed description and upon reference to the accompanying drawings in which.

Figure 1A:
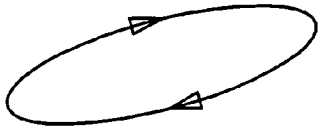
FIGS. 1A, 1B, 1D, 1E, and 1F depict embodiments of closed paths.

While the invention is susceptible to various modifications and alternative forms, specific embodiments thereof are shown by way of example in the drawings and may herein be described in detail. The drawings may not be to scale. It should be understood, however, that the drawings and detailed description thereto are not intended to limit the invention to the particular form disclosed, but on the contrary, the intention is to cover all modifications, equivalents, and alternatives falling within the spirit and scope of the present invention as defined by the appended claims.

DETAILED DESCRIPTION

In the context of this patent, the term "coupled" means either a direct connection or an indirect connection (e.g., one or more intervening connections) between one or more objects or components. The phrase "directly attached" means a direct connection between objects or components.

Figure 1B:
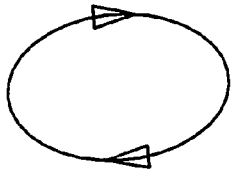
Figure 1C:
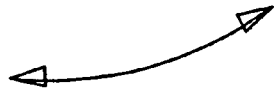
FIG. 1C depicts an embodiment of a curvilinear path.
Figure 1D:
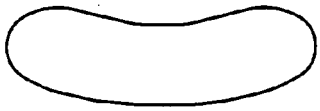
Figure 1E:
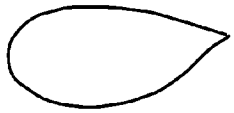
Figure 1F:
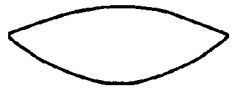

Aerobic exercise apparatus may be designed to create a variable path (e.g., a closed path or a reciprocating path) in space for limb engaging devices. For example, an exercise apparatus may create an approximately elliptical or approximately circular closed path in space (e.g., as shown in FIGS. 1A and 1B) for foot pedals or footpads to simulate a climbing, walking, striding, or jogging motion. In some embodiments, an exercise apparatus may create an approximately curvilinear path in space (e.g., as shown in FIG. 1C) for foot pedals or footpads to simulate a walking, striding, or jogging motion. Footpads may move in a repetitive manner along a closed path. A closed path may be defined as a path in which an object (e.g., a user's foot, footpad, or foot member) travels in a regular or irregular path around a point or an area. The shape of a closed path may depend on the generating linkage mechanism. For example, a closed path may be an elliptical path, a saddle-shaped path, an asymmetrical path (e.g., a closed path with a smaller radius of curvature on one side of the path as compared to the other side), or an ovate or egg-shaped path. Examples of closed paths are shown in FIGS. 1A, 1B, 1D, 1E, and 1F. In some embodiments, a closed path may be elliptical, orbital, or oblong. In certain embodiments, footpads may move in a repetitive manner along a curvilinear path or an arcuate path.

Exercise apparatus that create a defined path in space may have certain advantages. Certain advantages may include, but are not limited to, the reduction or elimination of impact on a user, an integrated inertia system that automatically causes directional change of the footpads, and/or a rapid learning curve for the user. These machines may, however, limit the range of motion of the user. An exercise apparatus that provides a user with a variable range of motion may advantageously provide compactness, controllable foot articulation patterns, and/or better variable stride control suitable for a greater variety of users.

In certain embodiments, certain types of systems may be used to provide a variable range of motion on an exercise apparatus. A "variable stride system" may be used to provide a variable range of motion on an exercise apparatus so that a user's stride length is variable during use of the apparatus. Variable stride systems may include cam type resistive/restoring devices and/or spring/damper type resistive/restoring devices. One or more portions of a variable stride system may be coupled to or incorporated as part of an exercise apparatus.

Figure 2A:
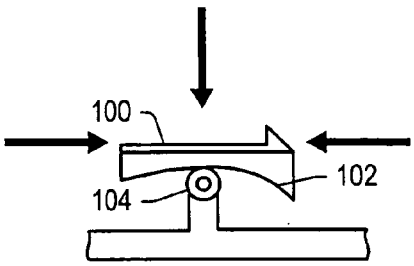
FIGS. 2A, 2B, 2C, and 2D depict embodiments of cam type resistive/restoring devices that may provide a variable range of motion in a closed path.

FIGS. 2A–2D depict embodiments of cam type resistive/restoring devices that may provide a variable range of motion in a closed path. In FIG. 2A, foot member 100 with cam device 102 engages roller 104. Foot member 100 may translate forward and rearward as surface of cam device 102 moves along roller 104. As a user steps on foot member 100, forces may be created by the interaction of the cam device surface and roller 104 such that the foot member is either accelerated or decelerated. In some embodiments, a slider may be used instead of roller 104 depicted in FIG. 2A. A slider may produce frictional drag forces, which in some cases may induce desirable damping forces.

Figure 2B:
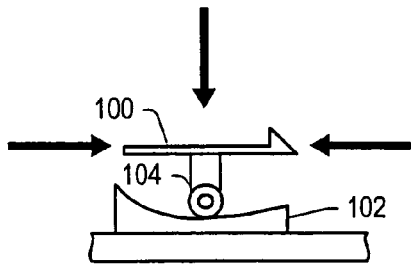
Figure 2C:
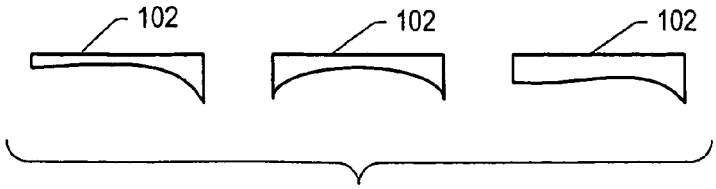
Figure 2D:
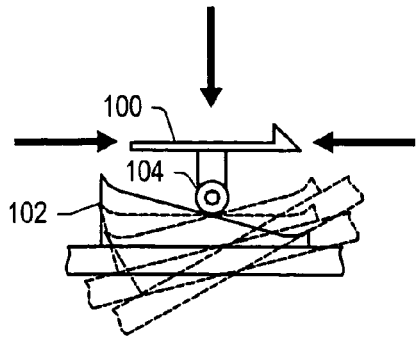

In FIG. 2B, the relationship between the cam device and roller is inverted. Roller 104 is directly attached to foot member 100. Cam device 102 is separate from foot member 100 and engages roller 104. FIG. 2C depicts a variety of surface shapes that may be used for cam device 102. The surface of cam device 102 may take on a variety of shapes depending on the objectives of a designer of an exercise apparatus. Certain profiles for cam device 102 may generate more or less restoring force. Cam device rotation during use of an exercise apparatus may affect the choice of the cam device surface shape by a designer. Portions of the cam device surface may be concave relative to the roller. In some embodiments, portions of the cam device surface may be convex relative to the roller. In some embodiments, portions of the cam device surface may also be straight and still generate restoring forces in certain configurations, as shown in FIG. 2D. The orientation of a cam device may change as a linkage system operates. For example, there may be rotation in space relative to a fixed reference plane such as the floor. In certain embodiments, this cam device rotation in space may be referred to as "cam device rotation". Cam device rotation during use of an exercise apparatus may cause the cam device surface to tilt relative to a roller. Restoring forces may be generated by this relative tilt to generate a desired performance of the exercise apparatus.

Figure 3A:
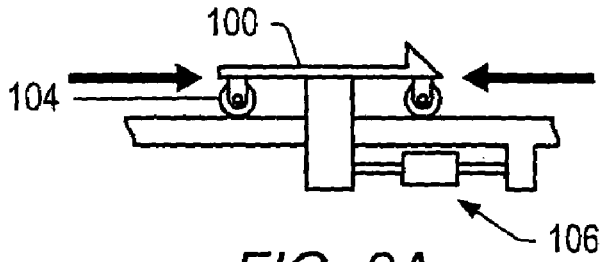
FIGS. 3A, 3B, 3C, and 3D depict embodiments of spring and/or damper devices that may provide a variable range of motion in a closed path.
Figure 3B:
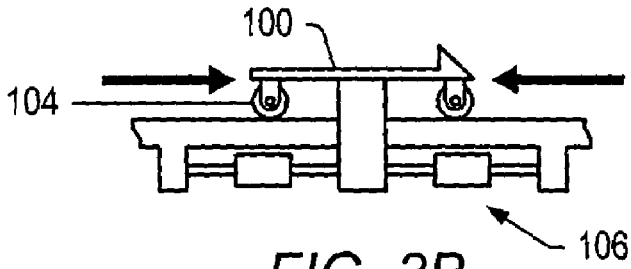
Figure 3C:
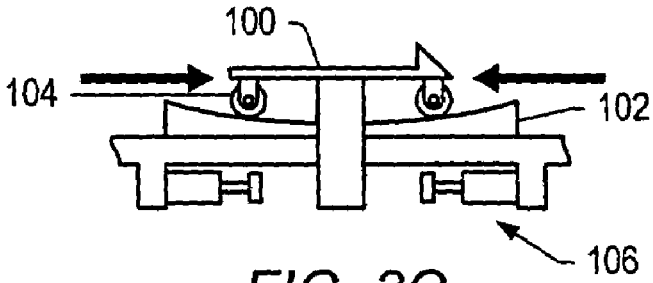
Figure 3D:
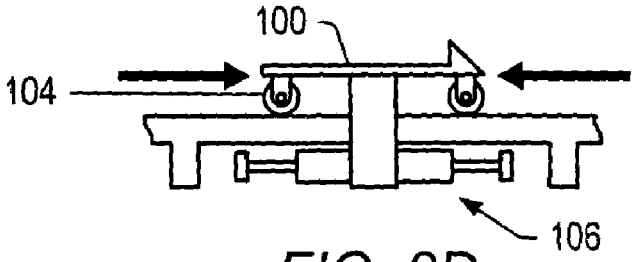

FIGS. 3A–3D depict embodiments of spring and/or damper devices that may provide a variable range of motion in a closed path. In certain embodiments, a spring/damper device may include a spring only, a damper only, a spring and damper combination in parallel, or a spring and damper combination in series. In an embodiment of a spring/damper device using only a damper, there typically will be resistive force without any restoring force. When a foot member is displaced from its neutral position, a spring/damper device resists movement of the foot member and may assist in returning the foot member to its neutral or start position. FIG. 3A depicts an embodiment of foot member 100 supported on rollers 104. Foot member 100 may translate back and forth supported by rollers 104. Spring/damper device 106 may resist motion of foot member 100 and provide a restoring force for the foot member. In some embodiments, foot member 100 may translate through a sliding motion without the use of rollers. In some embodiments, translation features for foot member 100 may be included in a telescoping system that allows relative translation between the telescoping components. Spring/damper device 106 may be located within the telescoping components. FIG. 3B depicts an embodiment with two spring/damper devices 106 in combination. FIG. 3C depicts an embodiment with foot member 100 able to translate between two spring/damper devices 106 and engage the spring/damper devices only toward the end of the foot member's travel. FIG. 3C also shows that spring/damper devices 106 may be used in combination with cam device 102. FIG. 3D depicts an embodiment with spring/damper devices 106 moving with foot member 100 and engaging stops to generate a resistive/restoring force.

Figure 4:
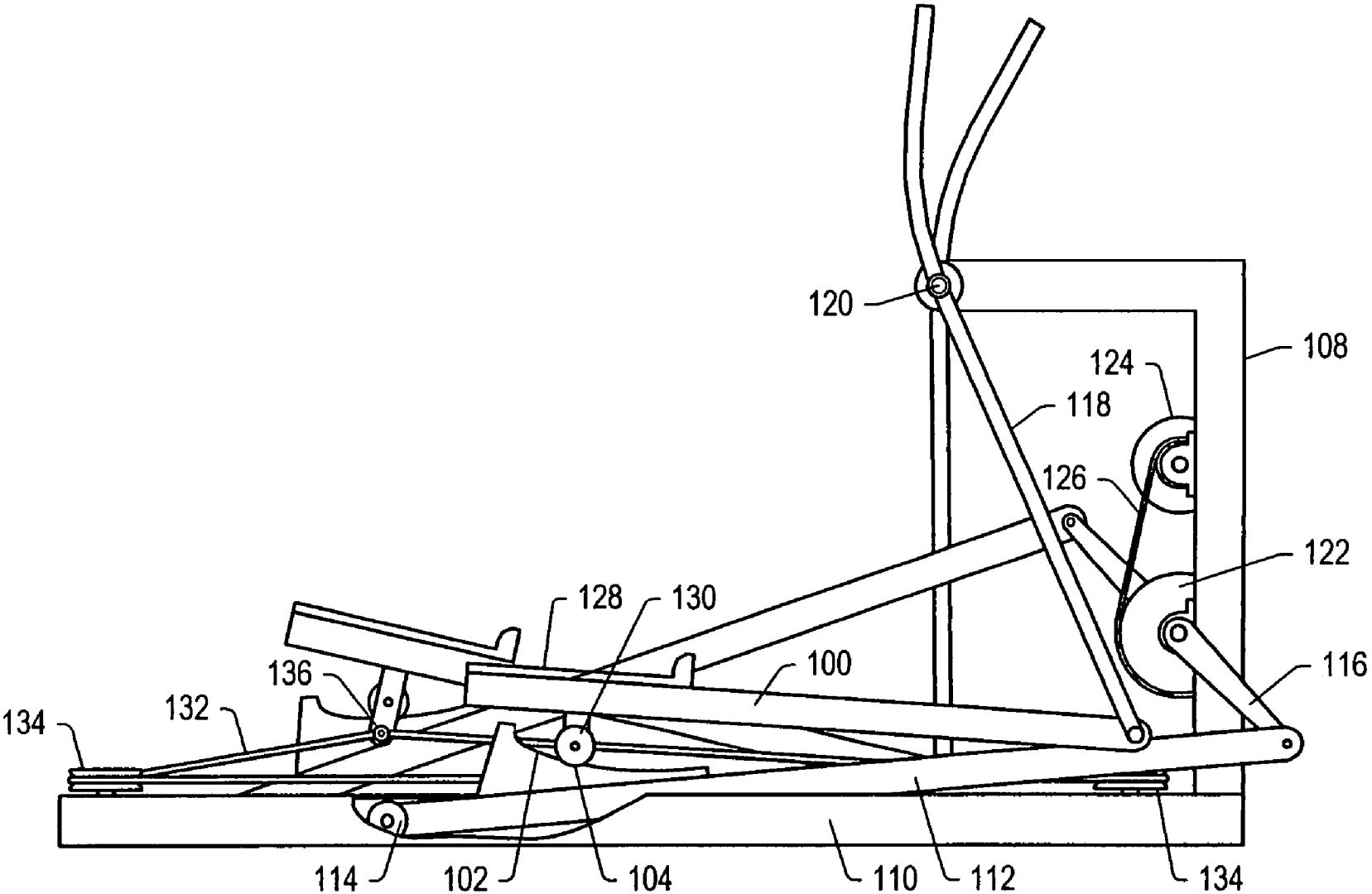
FIG. 4 depicts a side view of an embodiment of an exercise apparatus.

FIG. 4 depicts a side view of an embodiment of an exercise apparatus. Frame 108 may include a basic supporting framework and an upper stalk. Frame 108 may be any structure that provides support for one or more components of an exercise apparatus. In certain embodiments, all or a portion of frame 108 may remain substantially stationary during use. For example, all or a portion of frame 108 may remain substantially stationary relative to a floor on which the exercise apparatus is used. "Stationary" generally means that an object (or a portion of the object) has little or no movement during use.

In an embodiment, rails 110 may be coupled to and/or supported by frame 108. In some embodiments, frame 108 may perform the function of rails 110. In FIG. 4, both right and left sides of the linkage system are shown. The right and left sides of the linkage system may be used for the right and left feet of a user, correspondingly. The right and left sides of the linkage system may be mirror images along a vertical plane oriented along the center of the machine as viewed from above. In other embodiments depicted herein, only the left or right side may be shown. It is to be understood that in embodiments where only one side of the linkage system is depicted, the other side may be a mirror image of the depicted side.

Left and right movable members 112 may be supported at the rear by wheels 114. Wheels 114 may translate in rails 110. In certain embodiments, left and right movable members 112 may be movable members that move in a back and forth motion (i.e., one member moves forward as the other member moves backward in a reciprocating motion). In some embodiments, movable members 112 may be movable members that move in a closed path (e.g., a circular path, an elliptical path, or an asymmetrical path). The path or motion (e.g., reciprocating motion or closed path motion) of movable members 112 may be determined during the process of designing an exercise apparatus (e.g., by a designer of the exercise apparatus). For example, a designer of an exercise apparatus may design the linkage geometry of the exercise apparatus to provided a determined path of motion of movable members 112. The forward portions of movable members 112 may be pivotally coupled to crank members 116. Arm links 118 may be pivotally coupled to and supported by frame 108 at point 120. Arm links 118 may be pivotally coupled to foot members 100. In certain embodiments, arm links 118 may be directly attached (e.g., pivotally and directly attached) to foot members 100. Arm links 118 may be designed so that the upper portions can be used as grasping members (e.g., handles). A "pivotal linkage assembly" is generally an assembly that includes two or more moving links that are pivotally coupled to each other. In certain embodiments, a pivotal linkage assembly includes foot member 100 and arm link 118. In some embodiments, a pivotal linkage assembly may include one or more other components such as links, connectors, and/or additional members that couple to and/or provide coupling between foot member 100 and arm link 118 (e.g., movable member 112).

Crank members 116 may drive pulley device 122, which in turn may drive brake/inertia device 124 using belt 126. A "crank system" may include, in a generic case, crank member 116 coupled (either directly attached or indirectly attached) to pulley device 122. In some embodiments, a crank system may be formed from other types of devices that generally convert reciprocation or motion of a member to rotation. For example, a crank system may include a ring (e.g., a metal ring) supported by one or more rollers. In certain embodiments, a crank system may include one or more intermediate components between the crank member and the pulley (e.g., an axle or connectors). In certain embodiments, a crank system may be directly attached to frame 108. In some embodiments, a crank system may be indirectly coupled to frame 108 with one or more components coupling the crank system to the frame.

Foot member 100 may have footpads 128 or any other surface on which a user may stand. Footpad 128 is typically any surface or location on which a user's foot resides during use of an exercise apparatus (e.g., the footpad may be a pad or a pedal on which the user's foot resides during use). In some embodiments, footpad 128 may be a portion of foot member 100. Roller 104 may be coupled to foot member 100 by bracket 130. Roller 104 may engage movable member 112 at cam device 102. Cam device 102 may be formed to a specific shape to provide desired operating characteristics. In some embodiments, cam device 102 may be included as a part of movable member 112. In certain embodiments, cam device 102 and roller 104, or any other variable stride system, may be located within about 24 inches (e.g., about 18 inches or about 12 inches) of an end of footpad 128. In certain embodiments, at least a portion of a variable stride system (e.g., a cam device) may be located under (e.g., directly under) at least a portion of footpad 128.

The forward portion of movable member 112 is shown to be straight in FIG. 4. Movable member 112 may, however, be curved and/or include a bend. In certain embodiments, movable member 112 is made of a solid or unitary construction. In some embodiments, movable member 112 may include multiple components coupled or fastened to achieve a desired performance. Similarly, foot members 100 and arm links 118 may be straight, bent, or curved. Foot members 100 and arm links 118 may be unitary or may include multiple components.

In an embodiment, a user ascends the exercise apparatus, stands on footpads 128 and initiates a walking, striding, or jogging motion. The weight of the user on footpads 128 combined with motion of the footpads and foot members 100 causes a force to be transmitted to movable members 112 through roller 104 and cam device 102. This force in turn causes the rotation of crank members 116, pulley device 122, and/or brake/inertia device 124. As crank members 116 rotate, movable members 112 undertake a reciprocating motion near wheels 114. In an embodiment, foot member 100 and movable member 112 interact through roller 104, which is free to translate relative to movable member 112 at cam device 102. In certain embodiments, the interaction of foot member 100 and movable member 112 at cam device 102 (or any other variable stride system) may result in changing or dynamic angular relationship. The nature of the interaction and the magnitude and direction of the forces transmitted through roller 104 may be controlled by the shape and/or orientation of cam device 102.

As the user variably applies force on footpads 128, force may be transmitted through rollers 104 to movable members 112 that drive crank members 116. In certain embodiments, as crank members 116 rotate, the crank members may impart force to movable members 112, which in turn may impart force to foot members 100 through roller 104 and cam device 102, particularly at the end or beginning of a step or stride by the user. These forces may assist in changing direction of foot member 100 at the end or beginning of a step. In certain embodiments, these forces may assist in returning a user's foot to a neutral position during use. In an embodiment, the user determines and selects the actual stride length as foot members 100 are not pivotally coupled to movable members 112 and the foot members are allowed to translate relative to the movable members. The user may essentially be allowed to "instantaneously" or "dynamically" change his/her stride length by imparting variable forces to foot members 100. The user may selectively impart forces (e.g., at a beginning or an end of a stride) that vary the path (e.g., the path length or the shape of the path) of foot members 100. Thus, the user may vary his/her stride so that the path of foot members 100 is varied. In certain embodiments, cam device 102 may assist in imparting forces that change the direction of foot members 100.

In some embodiments, right and left side linkage systems (e.g., foot members 100, arm links 118, and/or movable members 112) may be cross coupled so that they move in direct and constant opposition to one another. This movement may be accomplished, as shown in FIG. 4, with a continuous belt or cable loop. Belt 132 may be a continuous loop supported and constrained by idler pulleys 134. Idler pulleys 134 may be located at either end of frame 108. Belt 132 may be coupled to foot members 100 at point 136. In certain embodiments, belt 132 is configured in a continuous loop coupled to the right side foot member and the left side foot member, thus causing the right and left foot members to move in direct and constant opposition to one another. The geometry of a linkage system (which may include foot members 100, cam devices 102, rollers 104, movable members 112, crank members 116, arm links 118, and/or brackets 130) may be such that the belt system (including belt 132 and idler pulleys 134) must accommodate either a change in pitch length or a change in distance between idler pulley centers. If the change in pitch length is slight, the change may be accommodated by belt stretch. Alternatively, one of the idler pulleys may be mounted using a spring tensioning system so that the distance between idler pulley centers may increase or decrease slightly during linkage system operation while maintaining tension in the belt loop.

Figure 4A:
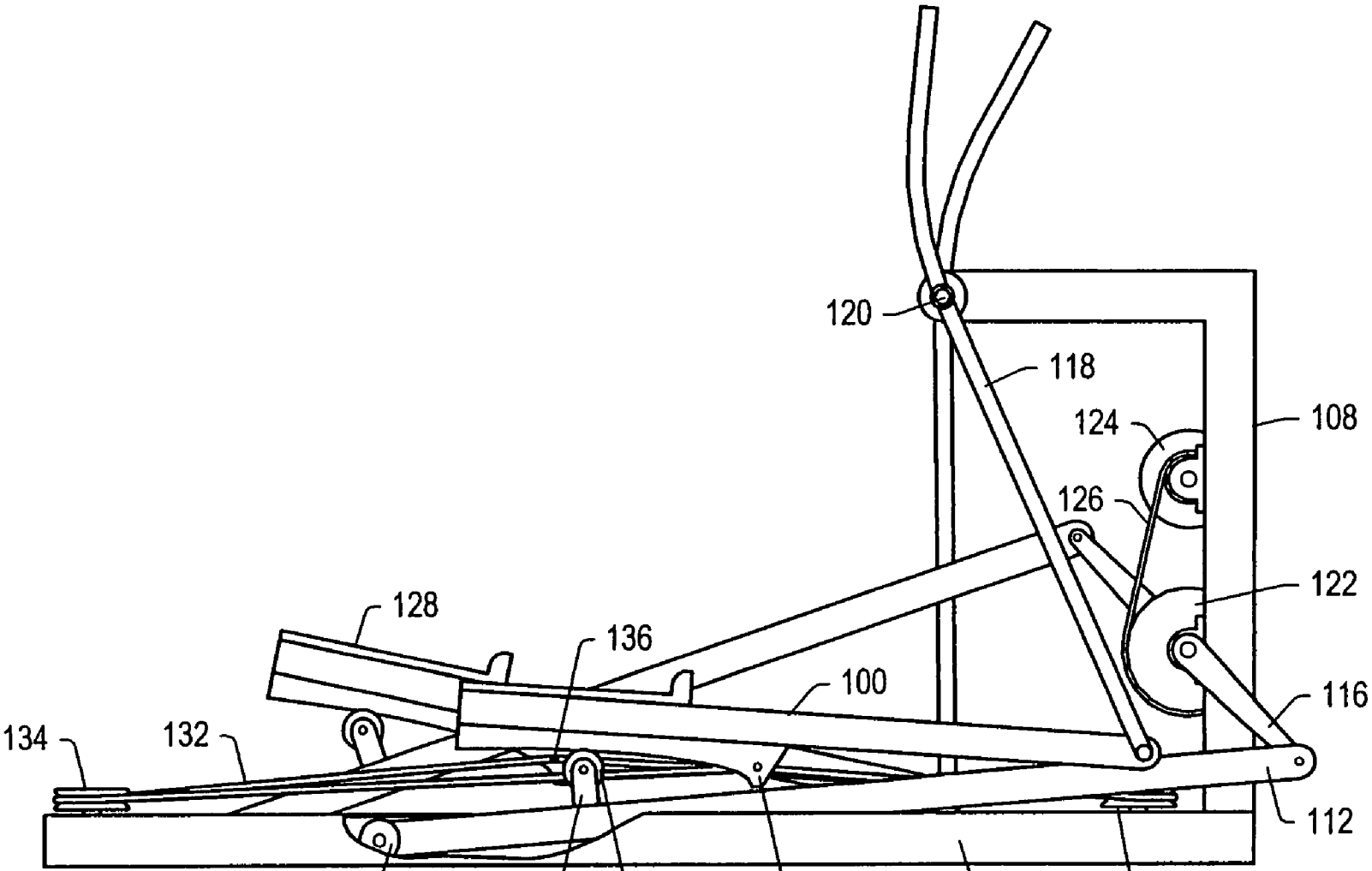
FIG. 4A depicts a side view of an embodiment of an exercise apparatus.

FIG. 4A depicts a side view of an embodiment of an exercise apparatus. The embodiment depicted in FIG. 4A operates in a similar manner to the embodiment depicted in FIG. 4. In FIG. 4A, however, roller 104 is coupled to movable member 112 with bracket 130. Roller 104 may be directly attached to movable member 112 with bracket 130. Roller 104 may engage foot member 100 through cam device 102. In FIG. 4A, the relationship between cam device 102 and roller 104 is inverted, or reversed, compared to the embodiment depicted in FIG. 4. In FIG. 4A, roller 104 and cam device 102 allow translation and create resistive/restoring forces similarly to the embodiment depicted in FIG. 4.

The embodiments depicted in FIGS. 4 and 4A may provide several advantages. In certain embodiments, a user's stride length may not be constrained by dimensions of components of the crank system (e.g., crank members 116, pulley device 122, and/or belt 126). Cam device 102 may allow a user to select a longer or shorter stride. A user may select a longer or shorter stride based on his/her own stride length. For example, in certain exercise apparatus, a stride length between about 4 inches and about 40 inches may be selected. For some exercise apparatus, a stride length between about 6 inches and about 36 inches may be selected. For yet other exercise apparatus, a stride length between about 6 inches and about 32 inches may be selected or a stride length between about 8 inches and about 30 inches may be selected.

In certain embodiments, a maximum stride length of an apparatus may be between about 35% and about 80% of an overall length of the apparatus. In certain embodiments, a maximum stride length of an apparatus may be at least about 40% of an overall length of the apparatus. In some embodiments, a maximum stride length of an apparatus may be at least about 50%, or at least about 60%, of an overall length of the apparatus. Having a larger maximum stride length to overall length ratio may allow an exercise apparatus to be more compact while maintaining a relatively larger user controlled variation in stride length. Designing and producing such an exercise apparatus may reduce costs (e.g., materials or construction costs) for building the exercise apparatus.

In certain embodiments, the exercise apparatus may assist in direction changes of foot members 100 at the end of a stride. In certain embodiments, cam device 102 is located (e.g., near a user's foot) such that a force equal to or greater than about 50% of the body weight of the user is applied through the cam device and roller 104 (or a spring/damper device) to the exercise apparatus. In some embodiments, nearly full body weight of the user is applied through cam device 102 and roller 104 to the exercise apparatus. This application of a large percentage of body weight may provide a designer the opportunity to create large or significant restoring forces in the exercise apparatus. These significant restoring forces may be advantageous, particularly at the end of a stride when foot members 100 and the linkage assembly must be decelerated and reaccelerated by cam device 102 to accomplish the desired direction change. These large restoring forces may provide assistance in direction change of the user's feet and may provide a more comfortable and natural exercise pattern for the user.

In certain embodiments, cam device 102 is located away from a crank system and/or a brake/inertia system. A housing used to enclose the crank system and/or the brake/inertia system may be of normal and reasonable size because of the location of the crank system and/or the brake/inertia system away from cam device 102. Thus, a housing may be more reasonable in size since the housing only includes the crank system and/or the brake/inertia system and does not enclose cam device 102 or other components that may increase the size of the housing. Using a smaller housing to enclose the crank system and/or the brake/inertia system may significantly save in costs for materials and construction of an exercise apparatus. These savings may be reflected in a selling price charged for an exercise apparatus.

In certain embodiments, use of a pivotal linkage assembly to interact with movable members 112 through cam device 102 allows control of foot articulation angles during use. In certain embodiments, a shorter overall length of frame 108, and thus the exercise apparatus, is achieved with a pivotal linkage assembly interacting with movable members 112 through cam device 102. Reducing the overall length of frame 108 may improve the commercial applicability of an exercise apparatus. Larger exercise apparatus may be significantly more expensive to produce and thus have a price that may significantly limit a commercial market for the larger exercise apparatus. Reducing the size of an exercise apparatus may reduce costs (e.g., materials or construction costs) for building the exercise apparatus and allow a lower selling price for the smaller exercise apparatus than a larger exercise apparatus, thus expanding the market for the smaller exercise apparatus.

Figure 5:
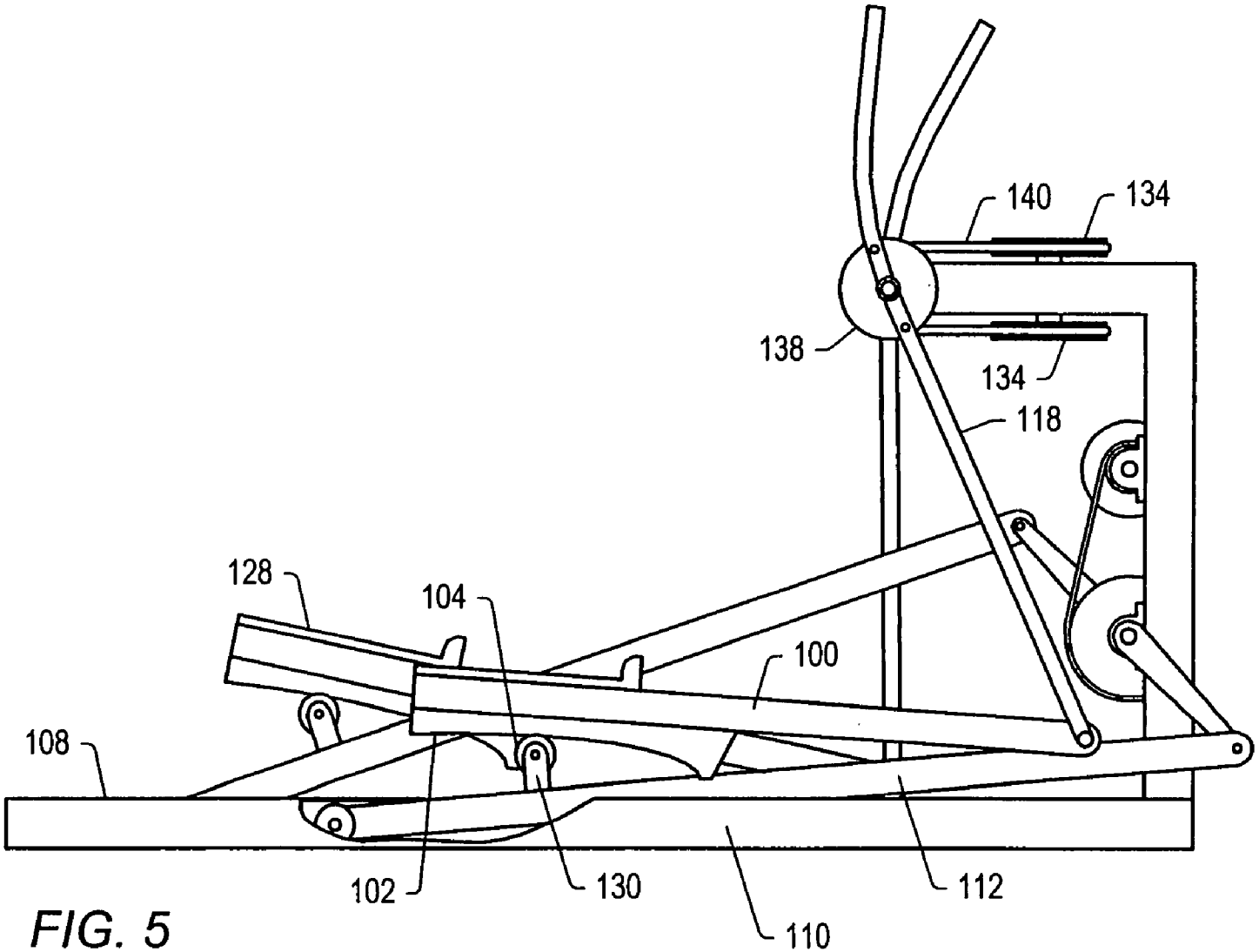
FIG. 5 depicts a side view of an embodiment of an exercise apparatus.

FIG. 5 depicts a side view of an embodiment of an exercise apparatus. The embodiment depicted in FIG. 5 operates in a similar manner to the embodiment depicted in FIG. 4. In FIG. 5, however, roller 104 is coupled (e.g., directly attached) to movable member 112 with bracket 130. Roller 104 may engage foot member 100 through cam device 102. In FIG. 5, the relationship between cam device 102 and roller 104 is inverted, or reversed, compared to the embodiment depicted in FIG. 4. In FIG. 5, roller 104 and cam device 102 allow translation and create resistive/restoring forces similarly to the embodiment depicted in FIG. 4.

FIG. 5 depicts an alternative method for cross coupling the right and left side linkage systems. Link pulleys 138 may be rigidly coupled to and rotate in unison with arm links 118. Idler pulleys 134 may be mounted to frame 108 and may rotate freely. Coupling belt 140 may be a continuous loop that wraps around link pulleys 138, both right and left sides, and idler pulleys 134, both upper and lower. Coupling belt 140 may be coupled to link pulleys 138 such that there is limited or no slip in the coupling belt. The coupling can be made by commonly available fasteners, or the belt and pulley may be cogged. In some embodiments, sections of roller chain engaging sprockets, rather than pulleys, may be used. The belt and pulley system, which includes link pulleys 138, idler pulleys 134, and/or coupling belt 140, may serve to cross couple the right side and left side linkage systems so that forward motion of the right side linkage system causes rearward motion of the left side linkage system, and vice versa. This type of cross coupling system may also be used in certain embodiments where foot members 100 cannot be easily or conveniently cross connected by a belt loop, as shown in FIG. 4.

Figure 6:
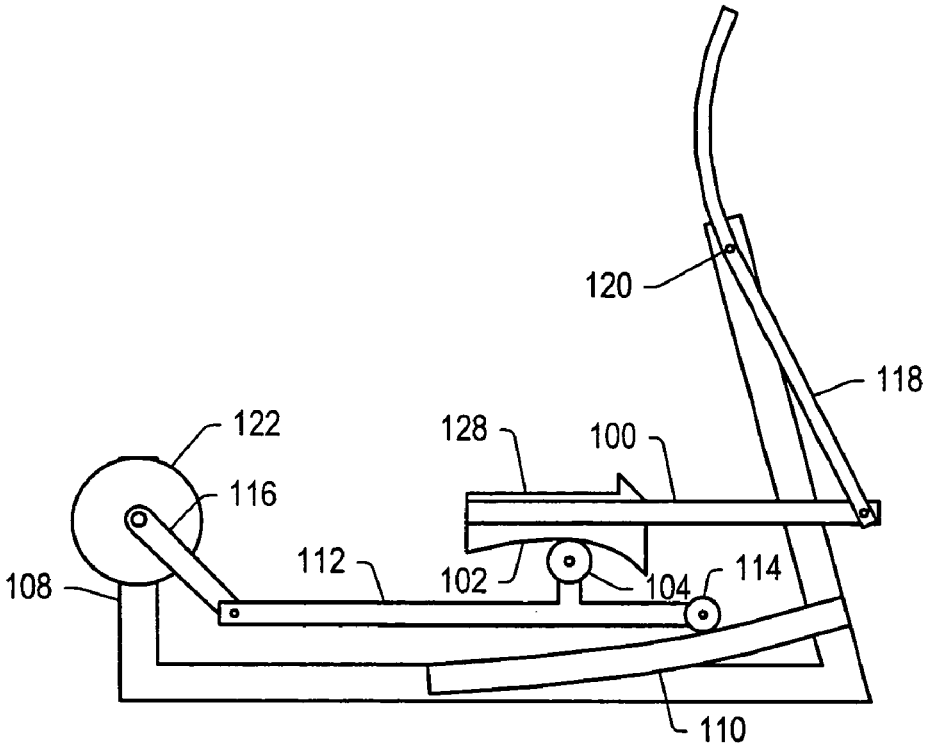
FIG. 6 depicts a schematic of an embodiment of an exercise apparatus.

The method for cross coupling depicted in FIG. 5 may be used in several embodiments depicted herein. Several embodiments depicted herein as schematics have been simplified for easier discussion of the pertinent features of each embodiment shown. Such depictions may not show one or more features that may be present in a fully functioning exercise apparatus. For example, only the right side linkage and crank system may be shown. In some embodiments, no pulley, belt, and/or brake/inertia system may be shown. In some embodiments, no linkage cross coupling system may be shown. In some embodiments, each of the members in a linkage system may be straight, may be curved, may be unitary, or may be composed of multiple pieces. In some embodiments, rails may be included in or coupled to the frame to engage rollers or wheels. Embodiments shown may operate either with cam device 102 above roller 104, or with the roller above the cam device (as depicted in FIG. 5). In certain embodiments, the crank and pulley may be in front of a location at which stands on the exercise apparatus (e.g., as shown in FIG. 5) or behind a location at which a user stands on the exercise apparatus (e.g., as shown in FIG. 6). In some embodiments, as shown in FIG. 6, rails 110, or a portion of frame 108 that engages rollers coupled to movable members 112, may be straight or curved and/or may be inclined.

FIG. 6 depicts a schematic of an embodiment of an exercise apparatus. FIG. 6 shows that the pivotal linkage assembly shown in FIG. 5 may be used in a rear drive configuration. Crank member 116 may be behind a user while arm link 118 may be in front of the user. In certain embodiments, cam device 102 may be coupled to foot member 100 while roller 104 may be coupled to movable member 112. In some embodiments, rails 110, or that portion of frame 108 that is engaged by wheels 114, may be curved and/or inclined.

Figure 7:
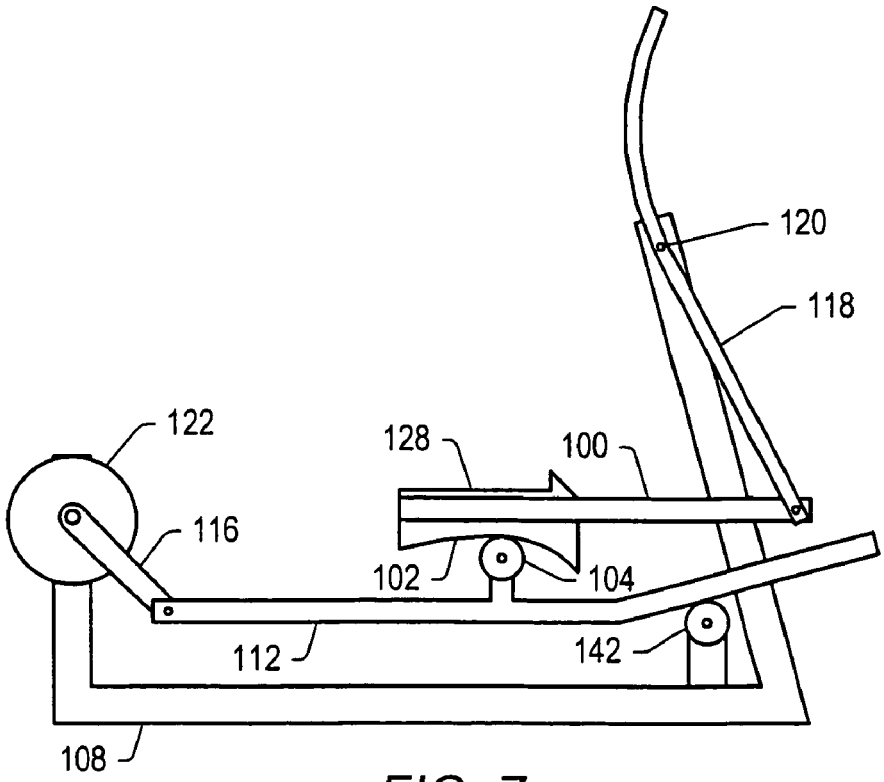
FIG. 7 depicts a schematic of an embodiment of an exercise apparatus.

FIG. 7 depicts a schematic of an embodiment of an exercise apparatus. Movable member 112 may be supported by stationary wheel 142. Movable member 112 may be free to translate relative to wheel 142. Cam device 102 may function similarly to the cam device depicted in the embodiment of FIG. 4.

Figure 8:
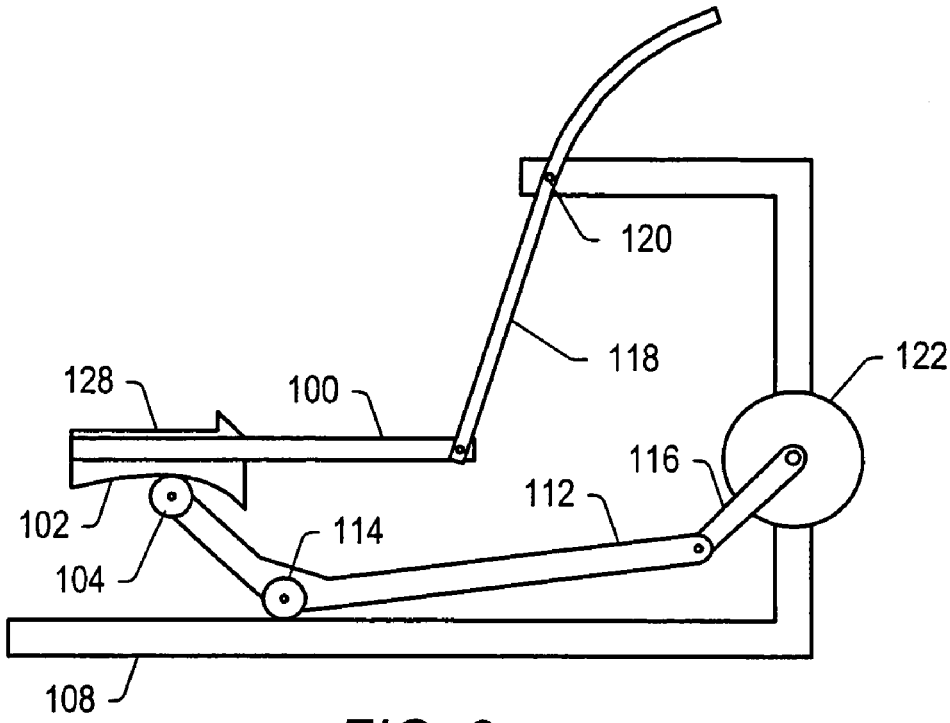
FIG. 8 depicts a schematic of an embodiment of an exercise apparatus.

FIG. 8 depicts a schematic of an embodiment of an exercise apparatus. Movable member 112 may be supported by wheel 114. Wheel 114 may be located at or near the mid portion of movable member 112. Cam device 102 and roller 104 may function similarly to the cam device and the roller depicted in the embodiment of FIG. 4. Wheel 114 may directly engage frame 108. In certain embodiments, rails coupled to, or supported by frame 108 may be used. Rails coupled to or supported by frame 108 may be used in any of the embodiments described herein. Examples of designs and uses of rails are described in the embodiments depicted in FIGS. 4 and 5.

Figure 9:
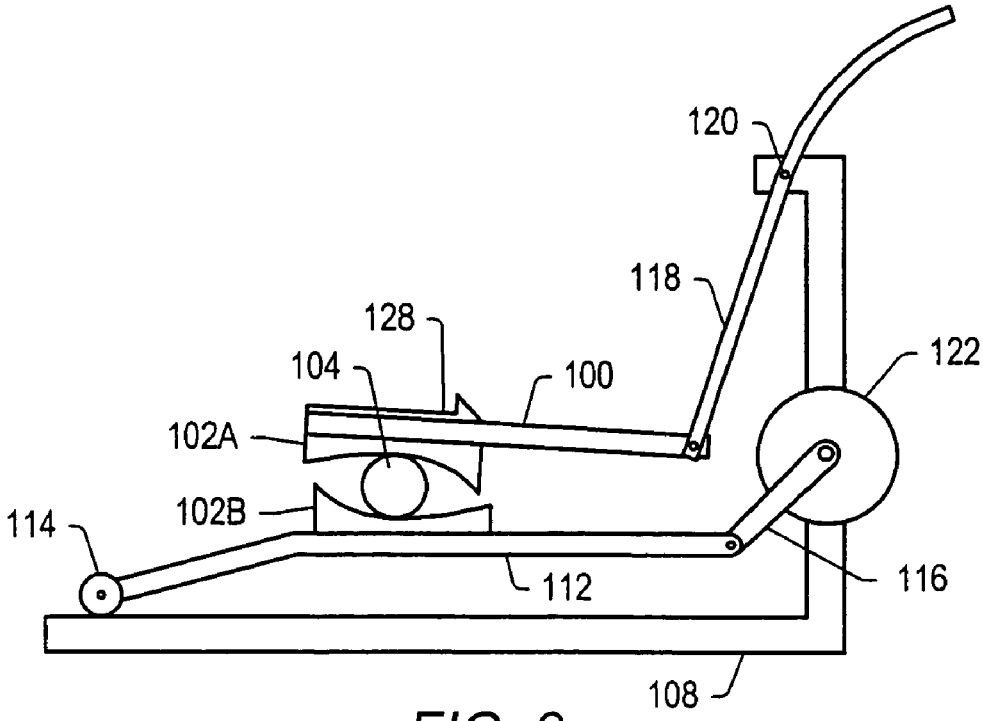
FIG. 9 depicts a schematic of an embodiment of an exercise apparatus.

FIG. 9 depicts a schematic of an embodiment of an exercise apparatus. The linkage system depicted in FIG. 9 may operate in a similar manner to the embodiment depicted in FIG. 4. Cam device 102A may be coupled to foot member 100. Cam device 102B may be coupled to movable member 112. Roller 104 may be located between and engage cam devices 102A and 102B. Roller 104 may roll and translate as cam devices 102A and 102B translate. Vertical forces applied by a user may be transformed into restoring/resisting forces by cam devices 102A and 102B. In some embodiments, cam devices 102A, 102B and roller 104 may have gear teeth to ensure positive engagement between the cam devices and the roller.

Figure 10:
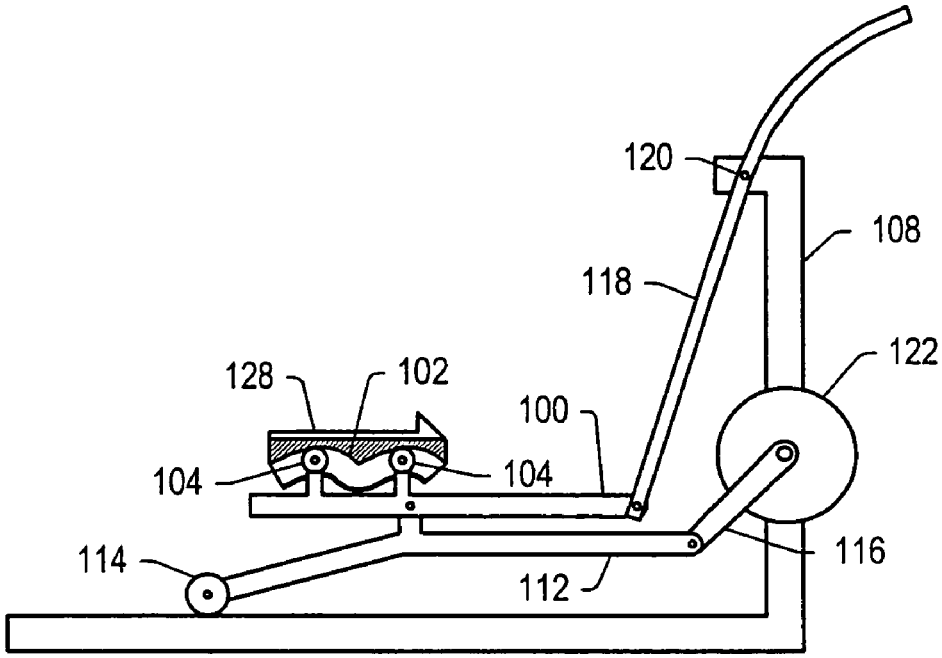
FIG. 10 depicts a schematic of an embodiment of an exercise apparatus.

FIG. 10 depicts a schematic of an embodiment of an exercise apparatus. Footpad 128 may be supported and stabilized by two rollers 104 engaging cam device 102. In an embodiment, cam device 102 has dual cam surfaces, as shown in FIG. 10. Cam device 102 may be designed so that a lower lip captures rollers 104 and inhibits footpad 128 from lifting off the rollers during use. The linkage system depicted in FIG. 10 may operate in a similar manner to the embodiment depicted in FIG. 4. Footpad 128, however, may translate independently of arm link 118. This independent translation may vary the range of motion of the user's foot while fixing the range of motion of the user's arm.

Figure 11:
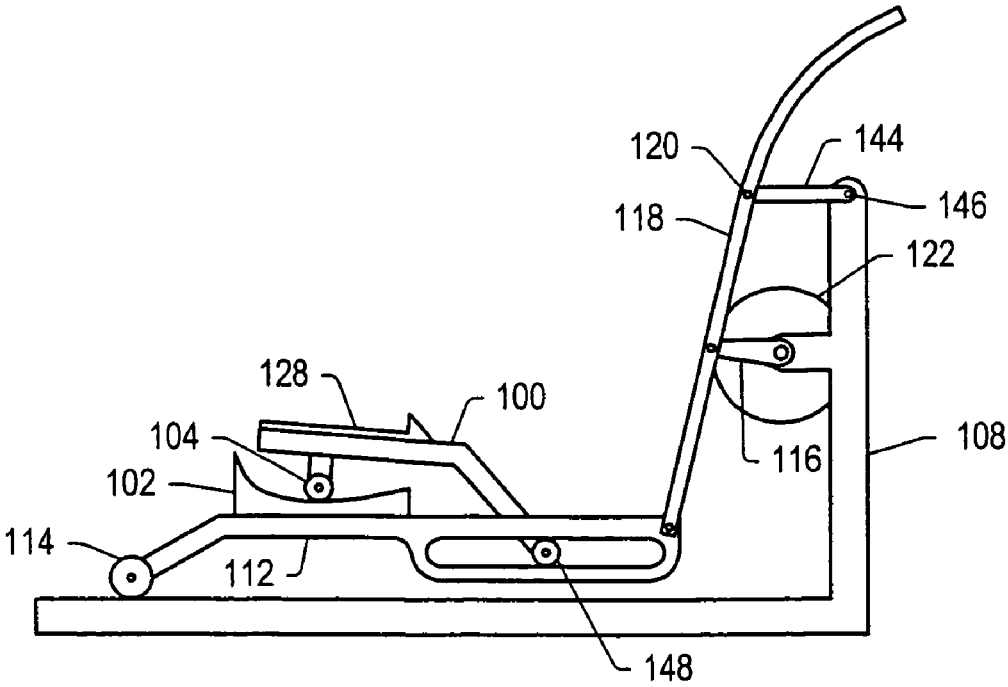
FIG. 11 depicts a schematic of an embodiment of an exercise apparatus.

FIG. 11 depicts a schematic of an embodiment of an exercise apparatus. Crank member 116 may be pivotally connected to arm link 118. Restraining link 144 may move in an arcuate pattern about pivot 146 as crank member 116 rotates. In turn, the lower and upper portions of arm link 118 may move in closed ovate paths. Movable member 112 may be pivotally coupled to a lower portion of arm link 118. Foot member 100 may engage cam device 102 through roller 104. Foot member 100 may be stabilized by roller 148. Roller 148 may engage and roll along movable member 112. In certain embodiments, roller 148 may be captured in a slot in movable member 112. The slot may have sufficient clearance to allow roller 148 to translate without simultaneously contacting the upper and lower surfaces of the slot.

Figure 12:
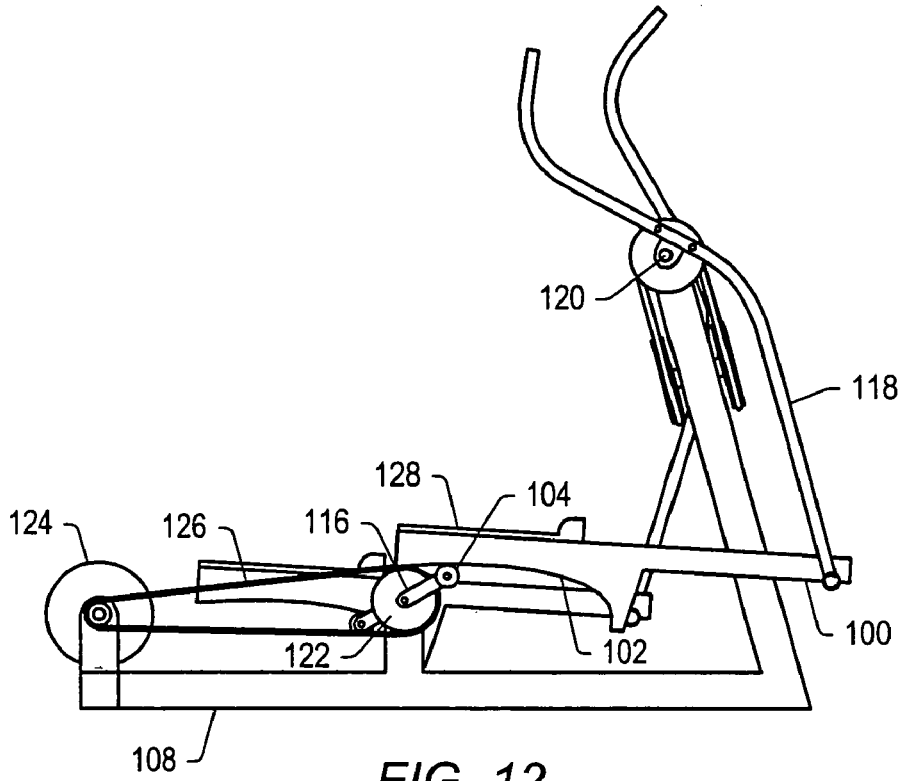
FIG. 12 depicts a side view of an embodiment of an exercise apparatus without tracks or rollers.

The embodiments depicted in FIGS. 4–11 show exercise apparatus that generate a closed path in space utilizing movable members 112 that engage a track or a roller associated with frame 108. FIG. 12 depicts a side view of an embodiment of an exercise apparatus without tracks or rollers. Frame 108 may include a basic supporting framework and an upper stalk. Crank members 116 may be coupled to a crankshaft and pulley device 122. Crank members 116, the crankshaft, and pulley device 122 may be supported by frame 108. Pulley device 122 may drive brake/inertia device 124 through belt 126. Crank member 116 may have roller 104 that engages cam device 102. Cam device 102 may be coupled (e.g., mounted) to foot member 100 or may be a part of the foot member. In certain embodiments, foot member 100 may be a pivotal foot member. Foot member 100 may be pivotally coupled at one end to arm link 118. Arm links 118 may be pivotally coupled to and supported by frame 108 at point 120. Arm links 118 may be designed such that the upper portions can be used as grasping members. Foot members 100 may have footpads 128 on which a user may stand. The linkage system may be cross coupled as previously described in the embodiment depicted in FIG. 5.

In an embodiment, a user ascends an exercise apparatus, stands on footpads 128 and initiates a walking, striding, or jogging motion. The weight of the user on footpad 128 may cause a force to be transmitted through cam device 102 and roller 104. This force may cause the rotation of crank member 116 and brake/inertia device 124. The interaction between rollers 104 and cam device 102 may allow relative horizontal displacement of footpads 128 with a restoring force. This interaction may allow variable stride closed path motion of foot members 100. In some embodiments, brake/inertia device 124 may be located ahead of a user or in front of a user.

Figure 13:
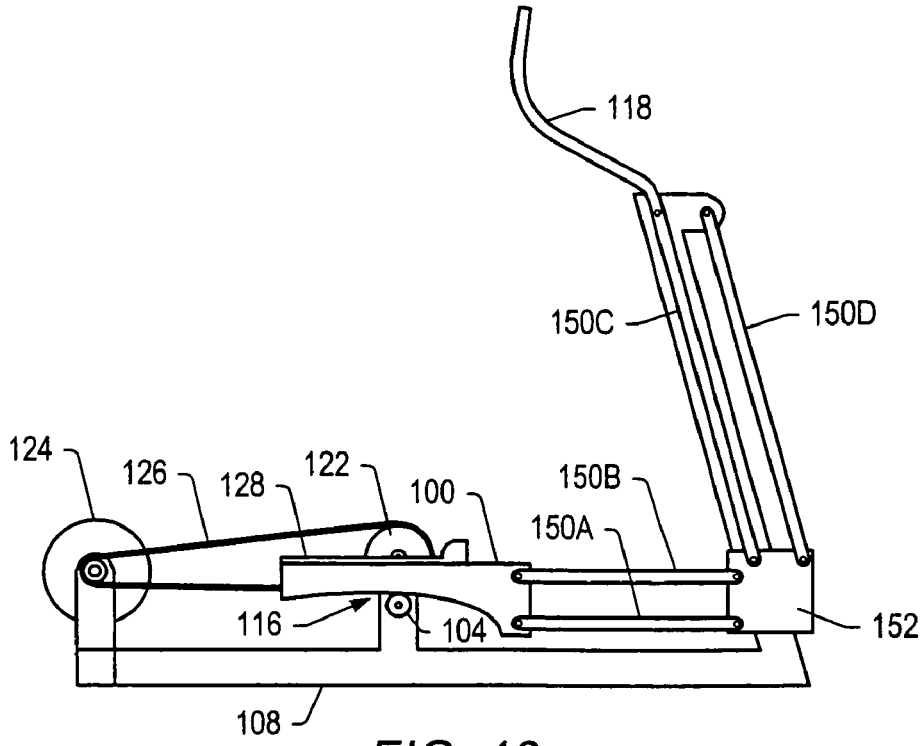
FIG. 13 depicts a schematic of an embodiment of an exercise apparatus.

FIG. 13 depicts a schematic of an embodiment of an exercise apparatus. The embodiment of FIG. 13 includes several features of the embodiment depicted in FIG. 12. FIG. 13 shows a system that utilizes a multilink connection to foot member 100 to control the orientation and rotation of the foot member. Links 150A, 150B, 150C, and 150D may work in unison with connector plate 152 to maintain foot member 100 substantially parallel to the floor during use. In some embodiments, a designer may alter the geometry of the linkage system by adjusting the lengths of links 150A, 150B, 150C, and 150D and/or the position of the connection points to induce a desired rotation pattern for foot member 100.

Figure 14:
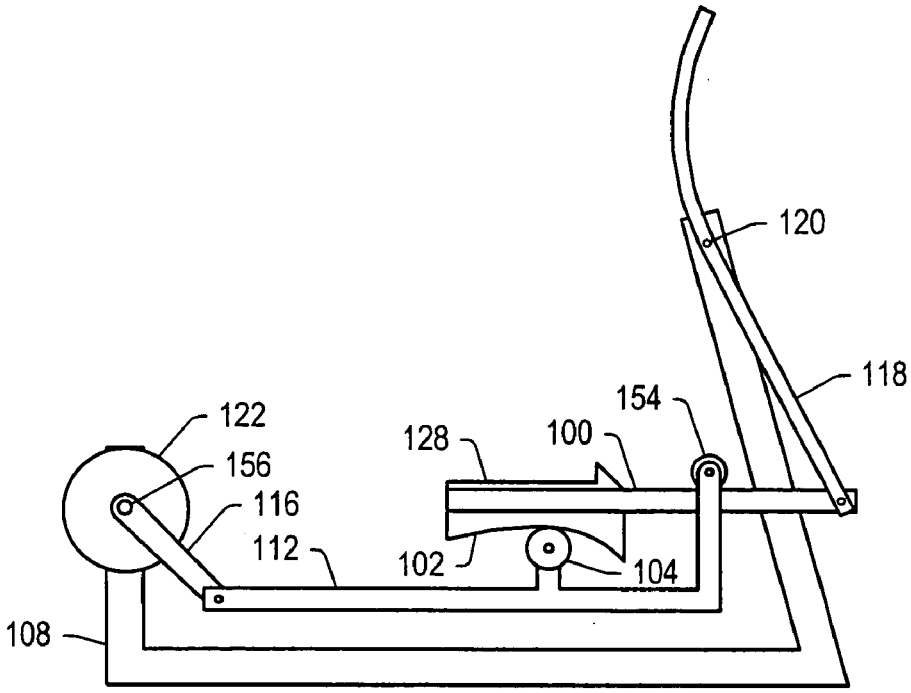
FIG. 14 depicts a schematic of an embodiment of an exercise apparatus.

FIG. 14 depicts a schematic of an embodiment of an exercise apparatus. Frame 108 may include a basic supporting framework and an upper stalk. Movable member 112 may be pivotally coupled to crank member 116. A forward portion of movable member 112 may engage foot member 100 at roller 154. Foot member 100 may have cam device 102. Arm link 118 may be pivotally coupled to and supported by frame 108 at point 120. Arm link 118 may be pivotally coupled to foot member 100. Arm link 118 may be designed such that the upper portions can be used as grasping members.

Foot member 100 may have footpad 128 on which a user may stand. Roller 104 may be coupled to movable member 112. Roller 104 may engage cam device 102. Foot member 100 and movable member 112 may form a reciprocating system that orbits crank shaft 156 at the rear while the forward portion of the system reciprocates along a curvilinear path.

A user may ascend the exercise apparatus, stand on footpads 128 and initiate a walking, striding, or jogging motion. The weight of the user on footpad 128 combined with motion of the footpad and foot member 100 may cause a force to be transmitted to movable member 112 through cam device 102. This force may cause rotation of crank member 116 and a brake/inertia device. The interaction between roller 104 and cam device 102 may allow relative horizontal displacement of foot member 100 with a restoring force. This interaction may allow a variable stride closed path motion of foot member 100.

Figure 15:
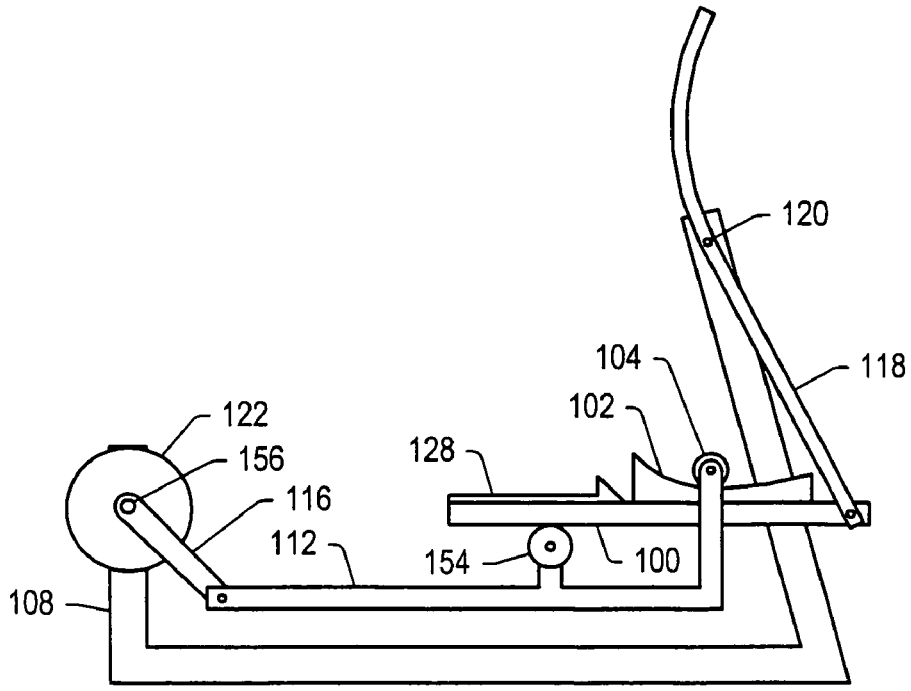
FIG. 15 depicts a schematic of an embodiment of an exercise apparatus.
Figure 16:
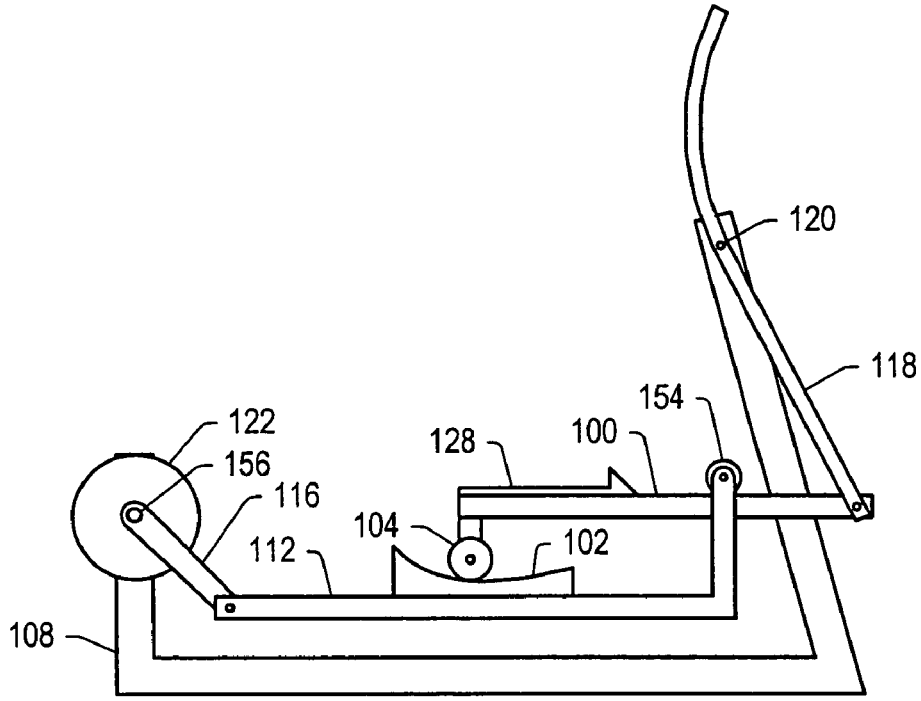
FIG. 16 depicts a schematic of an embodiment of an exercise apparatus.

In some embodiments, cam device 102 and roller 104 may be placed on the top portion of foot member 100, as depicted in FIG. 15. Roller 154 may contact a lower portion of foot member 100. In some embodiments, cam device 102 may be placed on an upper surface of movable member 112, as depicted in FIG. 16.

Figure 17:
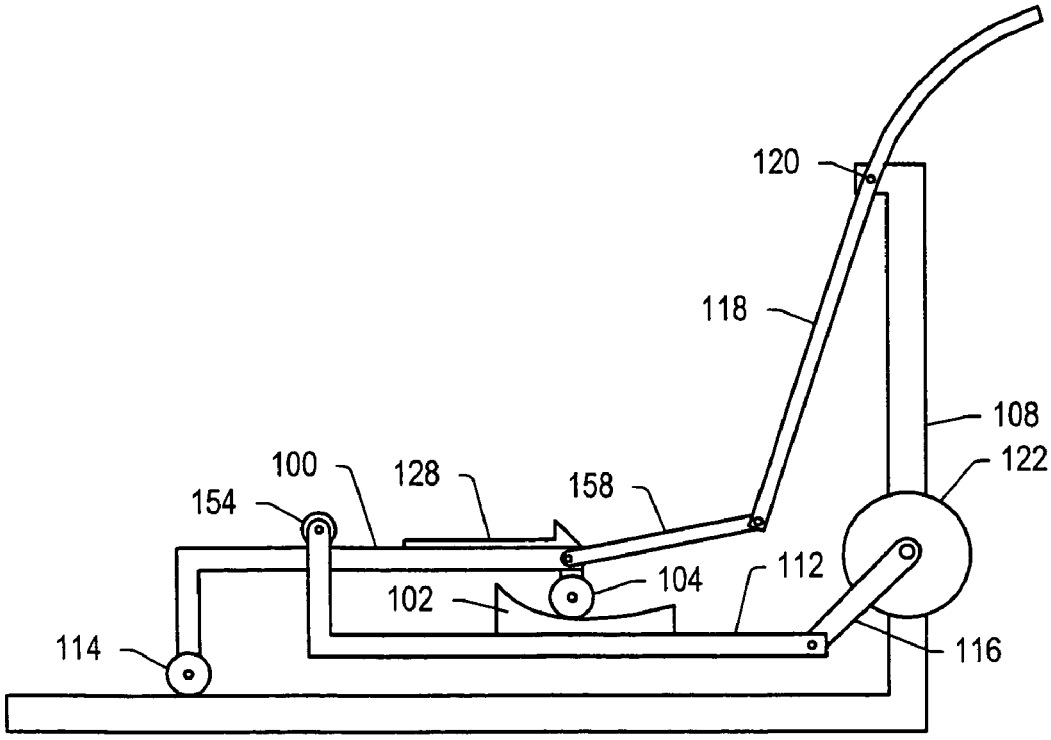
FIG. 17 depicts a schematic of an embodiment of an exercise apparatus.

FIG. 17 depicts a schematic of an embodiment of an exercise apparatus. In an embodiment, a reciprocating system may include foot member 100 and movable member 112. Wheel 114 may be coupled to foot member 100 and engage frame 108. Link 158 may couple foot member 100 to arm link 118. Link 158 may be coupled to foot member 100 at or near a position of roller 104. The embodiment depicted in FIG. 17 is a front drive system with the crank positioned in front of a user.

Figure 18:
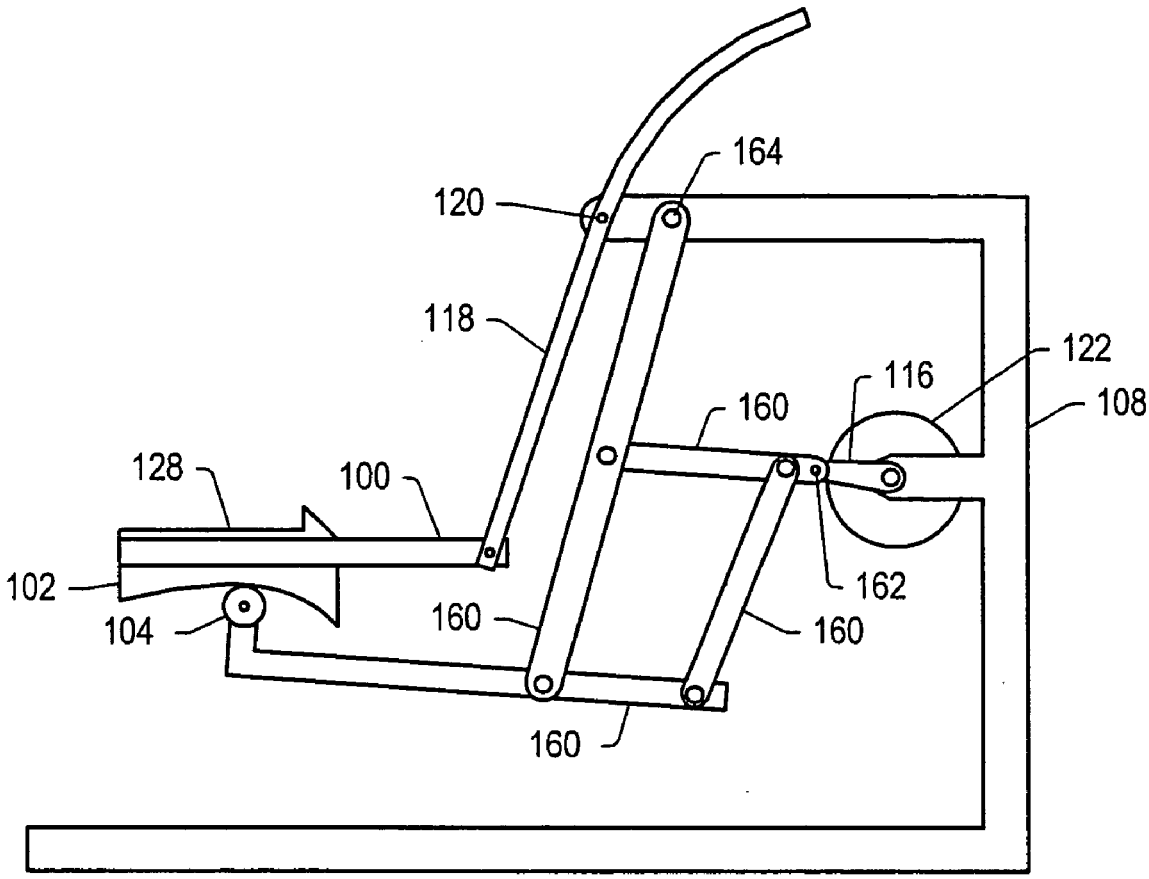
FIG. 18 depicts a schematic of an embodiment of an exercise apparatus.

FIG. 18 depicts a schematic of an embodiment of an exercise apparatus. Multibar linkage system 160 may be coupled to crank member 116 at point 162. Multibar linkage system 160 may be supported by frame 108 at point 164. Points 162 and 164 may be pivot points. The action of multibar linkage system 160 in combination with the rotation of crank member 116 may create a closed ovate path at roller 104. Cam device 102 may engage roller 104.

Figure 19:
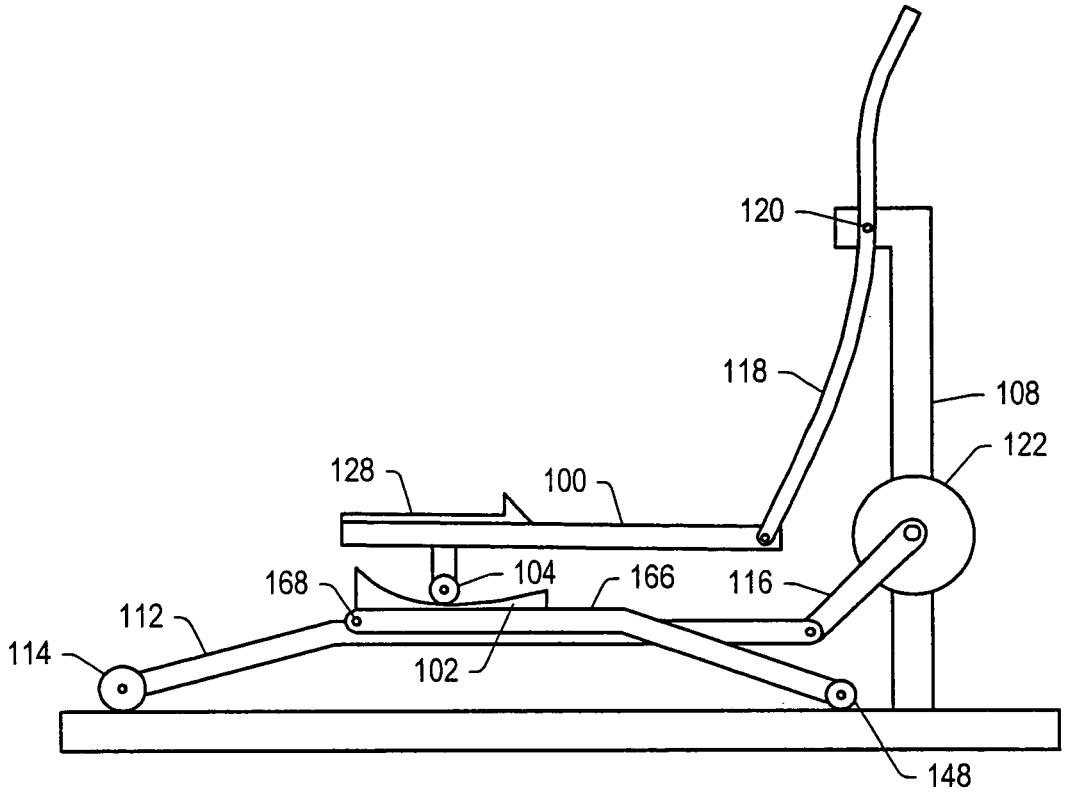
FIG. 19 depicts a schematic of an embodiment of an exercise apparatus with an articulating cam device.

In certain embodiments (e.g., embodiments depicted in FIGS. 4–18), cam device 102 may be directly attached to movable member 112 or to foot member 100. Rigidly fixing the cam device causes the cam device to rotate with and move with the member to which the cam device is directly attached. In some embodiments, controlling rotation of the cam device independently of the member to which the cam device is coupled may be advantageous. FIG. 19 depicts a schematic of an embodiment of an exercise apparatus with an articulating cam device. Frame 108 may include a basic supporting framework and an upper stalk. Movable member 112 may be pivotally coupled to crank member 116. Movable member 112 may be supported at an end opposite crank member 116 by wheel 114. Wheel 114 may engage frame 108. Foot member 100 may have roller 104 that engages cam device 102. Cam device 102 may be coupled (e.g., mounted) to pivotal member 166. Pivotal member 166 may be coupled at point 168 to movable member 112. Point 168 may be a pivotal point. Pivotal member 166 may be supported at an end distal from point 168 by roller 148. Roller 148 may engage frame 108. In certain embodiments, the portion of frame 108 that is engaged by roller 148 may be straight and level. In some embodiments, the portion of frame 108 that is engaged by roller 148 may be inclined and/or curved. Arm link 118 may be pivotally coupled to and supported by frame 108 at point 120. Arm link 118 may be pivotally coupled to foot member 100. Arm link 118 may be designed such that upper portions of the arm links can be used as grasping members. Foot member 100 may have footpad 128 on which a user may stand.

In an embodiment, a user may ascend the exercise apparatus, stand on footpads 128, and initiate a walking, striding, or jogging motion. The weight of the user on footpad 128 may cause a force to be transmitted through roller 104, cam device 102, and point 168 to movable member 112. This force may cause the rotation of crank member 116 and a brake/inertia device. The interaction between roller 104 and cam device 102 may allow relative horizontal displacement of foot member 100 with a restoring force. This interaction may allow variable stride closed path motion of foot member 100. As the system (e.g., foot member 100) moves, pivotal member 166 may orient and control the angular position of cam device 102 relative to movable member 112. Such control of the angular position of cam device 102 may allow a designer to more precisely control the translational forces created by the surface of the cam device interacting with roller 104. The designer may choose to minimize rotation of the cam device during certain portions of the closed path motion.

Figure 20:
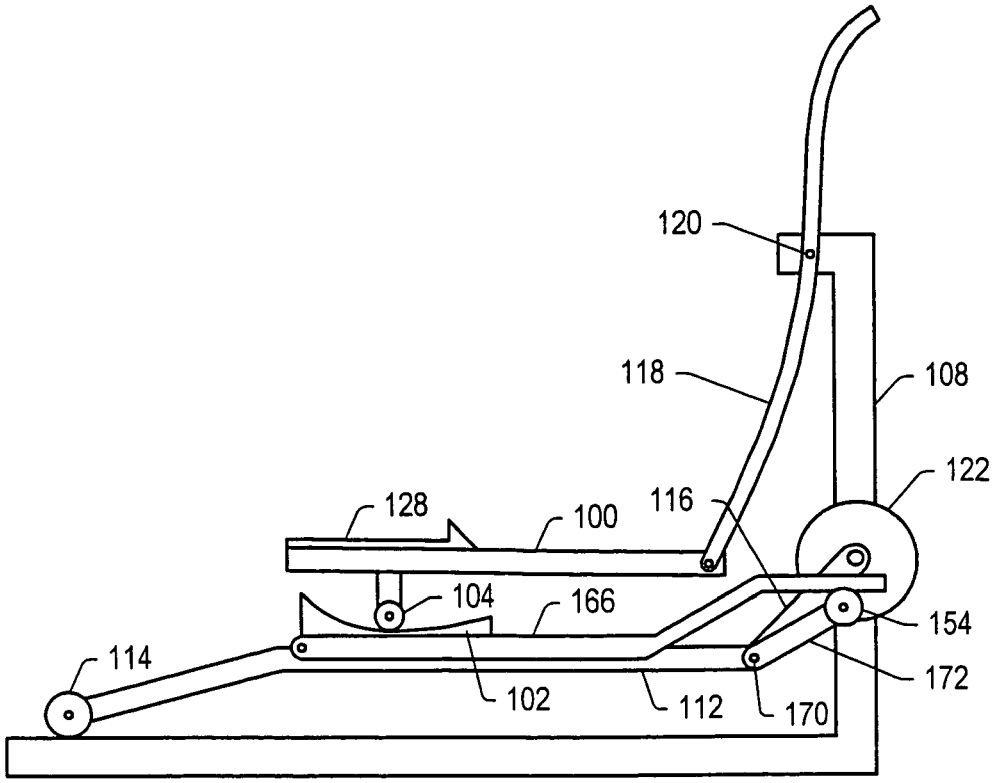
FIG. 20 depicts a schematic of an embodiment of an exercise apparatus with a dual radius crank.

FIG. 20 depicts a schematic of an embodiment of an exercise apparatus with a dual radius crank. Crank member 116 may be coupled to movable member 112 at journal 170. Secondary crank member 172 may be rigidly coupled to crank member 116. Secondary crank member 172 may rotate in unison with crank member 116. Roller 154 may be coupled to secondary crank member 172 and may define an inner radius of motion. Pivotal member 166 may rest on roller 154. As crank members 116 and 172 rotate, the angular orientation of a surface of cam device 102 may be controlled by the interaction of pivotal member 166 and roller 154. A designer may alter the size and position of secondary crank member 172 and the shape of pivotal member 166 to achieve a desired rotational pattern of cam device 102.

Figure 21:
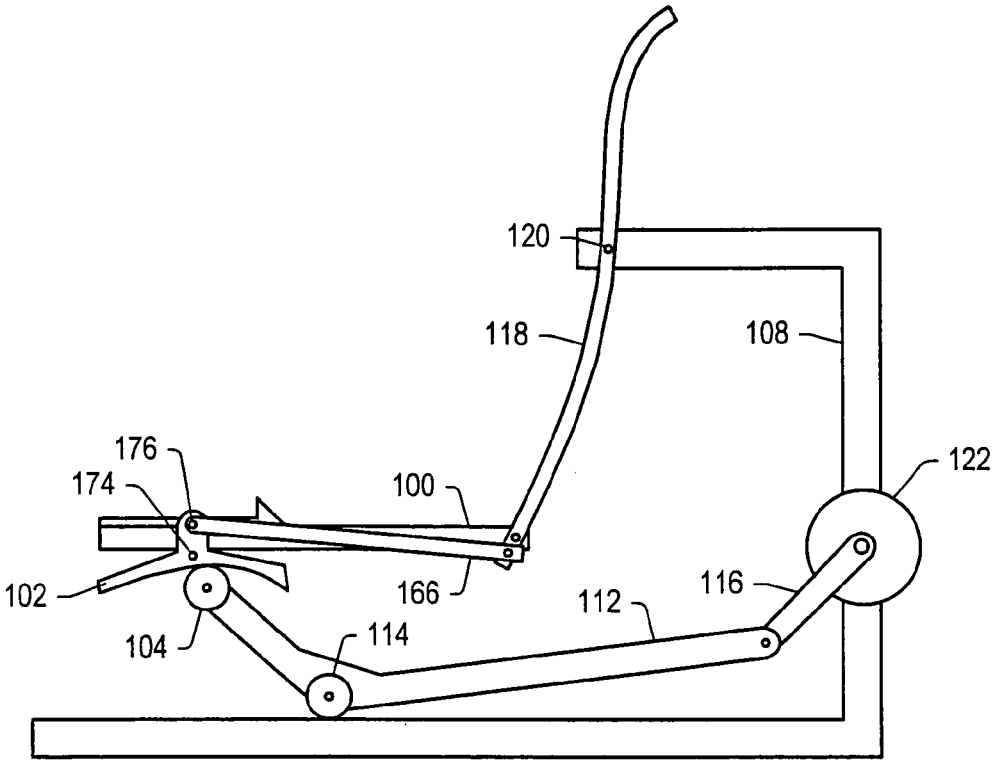
FIG. 21 depicts a schematic of an embodiment of an exercise apparatus.

FIG. 21 depicts a schematic of an embodiment of an exercise apparatus. Cam device 102 may be pivotally coupled to foot member 100 at point 174. Pivotal member 166 may be pivotally coupled to cam device 102 at point 176. Pivotal member 166 may be pivotally coupled to arm link 118 at or near an end of the pivotal member opposite from point 176. As the system operates, the angular orientation of cam device 102 may be controlled by the interaction of pivotal member 166 and arm link 118. A designer may alter the linkage geometry to achieve a desired angular control of cam surface 102.

Figure 22:
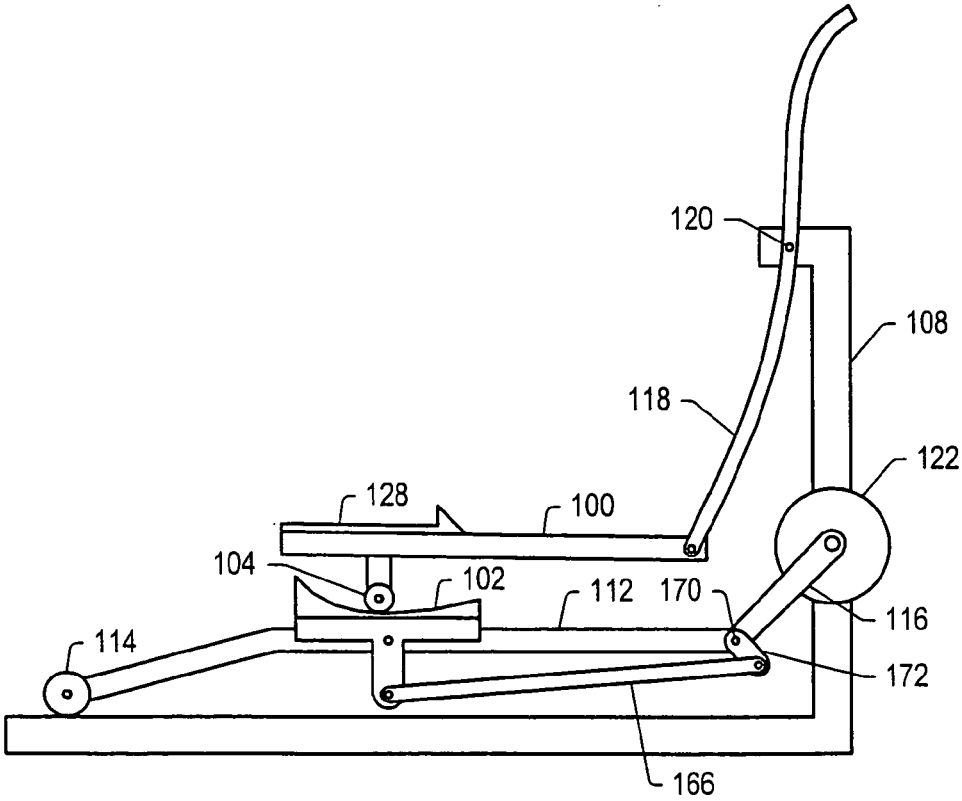
FIG. 22 depicts a schematic of an embodiment of an exercise apparatus.

FIG. 22 depicts a schematic of an embodiment of an exercise apparatus. In some embodiments, cam device 102 may be mounted to movable member 112. In certain embodiments, cam device 102 may be pivotally mounted to movable member 112. Movable member 112 may be coupled to crank member 116 at journal 170. The angular orientation of cam device 102 may be controlled by pivotal member 166. Pivotal member 166 may be pivotally coupled to secondary crank member 172. Secondary crank member 172 may be rigidly coupled to crank member 116 (as shown in FIG. 20). Secondary crank member 172 may rotate in unison with crank member 116. A designer may alter the geometry of cam device 102, pivotal member 166, and secondary crank member 172 to achieve a desired angular control of the cam device surface.

Figure 23:
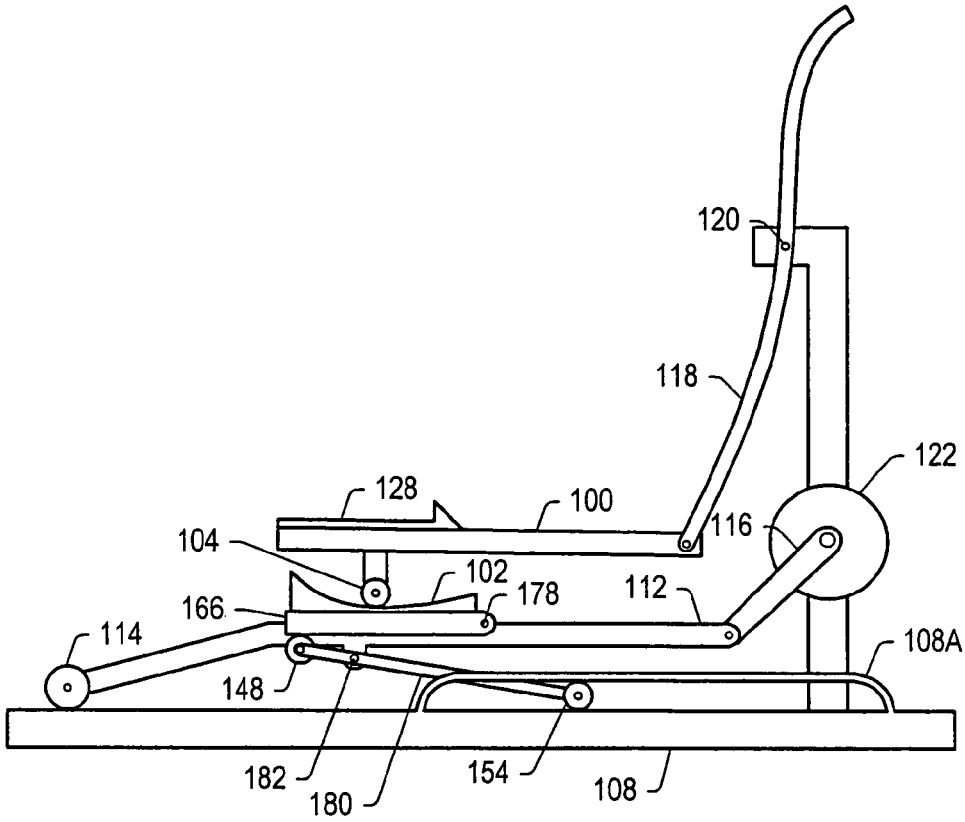
FIG. 23 depicts a schematic of an embodiment of an exercise apparatus.

FIG. 23 depicts a schematic of an embodiment of an exercise apparatus. Crank member 116 may be coupled to movable member 112. Pivotal member 166 may be coupled at its forward end to movable member 112 at point 178. Point 178 may be a pivot point. Actuation arm 180 may be pivotally coupled at point 182 to movable member 112. Roller 148 may engage the underside of pivotal member 166. Roller 154 may engage frame 108. Roller 154 may be vertically restrained by part 108A. Part 108A may be a portion of frame 108 or an addition to the frame. As crank member 116 rotates, the position of movable member 112 may change in space leading to rotation of actuation arm 180 around point 182. Rotation of actuation arm 180 may cause the rotation of pivoting member 166 relative to movable member 112. A designer may specify the geometry of the system including the location of point 182 and the length and proportions of actuation arm 180 to create a desired rotation pattern for cam device 102.

Figure 24:
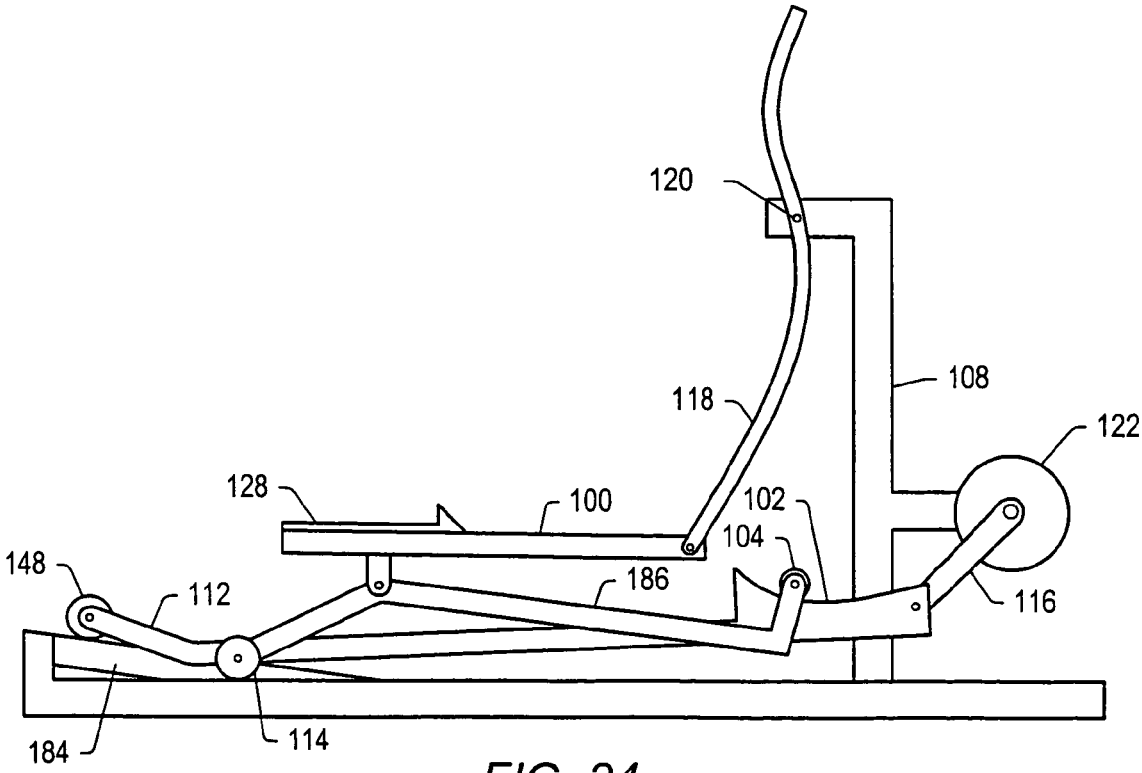
FIG. 24 depicts a schematic of an embodiment of an exercise apparatus.

FIG. 24 depicts a schematic of an embodiment of an exercise apparatus. Cam device 102 may be coupled to or made an integral part of movable member 112. Cam device 102 may be located on movable member 112 closest to crank member 116. In some embodiments, cam device 102 may be located at an end of movable member 112 away from crank member 116. Movable member 112 may be pivotally coupled to crank member 116. Movable member 112 may be supported at its rear by frame portion 184. Frame portion 184 may be a roller engaging portion of frame 108. A front portion of translating member 186 may engage cam device 102 through roller 104. A rear portion of translating member 186 may be supported by roller 148. Roller 148 may engage frame portion 184. Frame portion 184, which is engaged by roller 148, may be inclined and/or curved. Foot member 100 may be pivotally coupled to translating member 186. Foot member 100 may be supported at its front by a pivotal connection to arm link 118. Footpad 128 may be coupled to foot member 100. A designer may select linkage geometry and the shape and orientation of frame portion 184 to create a desired cam device articulation pattern.

Figure 25:
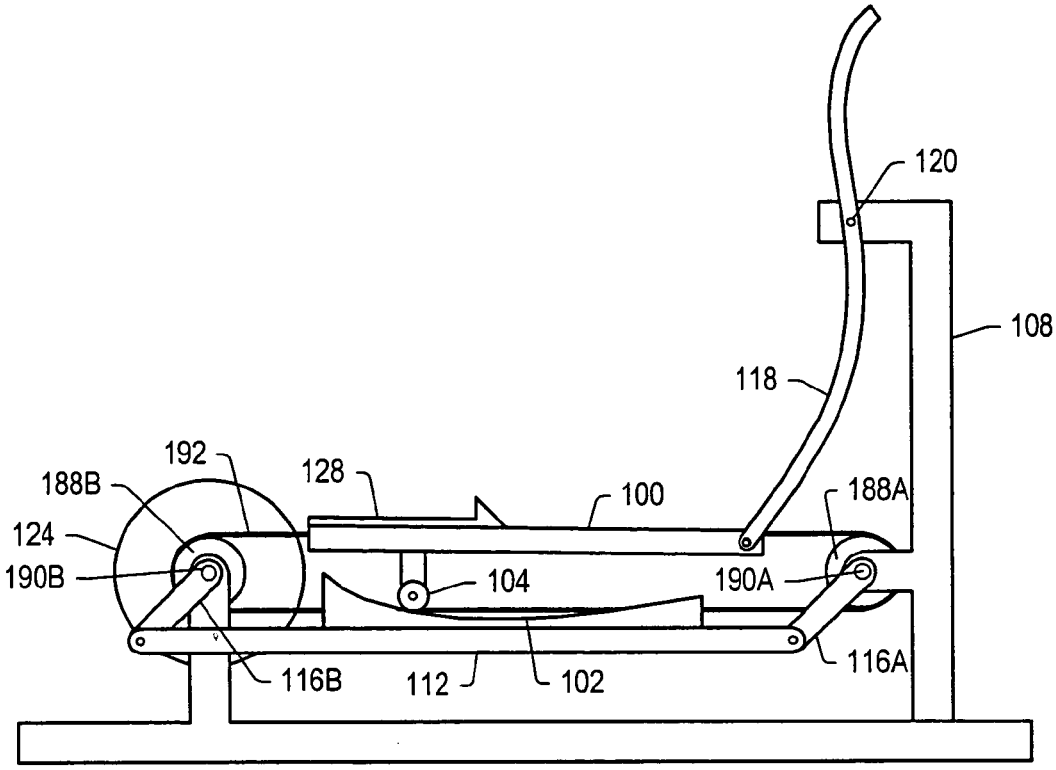
FIG. 25 depicts a schematic of an embodiment of an exercise apparatus that uses dual cranks.

In some embodiments, rotation of a cam device may be controlled by the use of dual cranks. FIG. 25 depicts a schematic of an embodiment of an exercise apparatus that uses dual cranks. Frame 108 may include a basic supporting framework and an upper stalk. Movable member 112 may be pivotally coupled to crank members 116A and 116B. In an embodiment, crank members 116A and 116B are the same size. Movable member 112 may be supported at each end through a pivotal coupling by crank members 116A and 116B. Foot member 100 may have roller 104. Roller 104 may engage cam device 102. Cam device 102 may be coupled to (e.g., mounted to) movable member 112. Arm link 118 may be pivotally coupled to and supported by frame 108 at point 120. Arm link 118 may be pivotally coupled to foot member 100. Arm link 118 may be designed such that the upper portions can be used as a grasping member. Foot member 100 may have footpad 128 on which a user may stand. Sprockets 188A and 188B may be mounted and directly attached through shafts 190A and 190B to crank members 116A and 116B, respectively. In an embodiment, chain 192 couples sprockets 188A and 188B in such a way that crank members 116A and 116B are in phase and always at the same angle relative to a horizontal reference line. In certain embodiments, brake/inertia device 124 may be coupled to shaft 190B to create braking forces and smoothing inertial forces. In some embodiments, chain 192 may be a gearbelt and sprockets 188A and 188B may be gearbelt pulleys.

In an embodiment, a user may ascend the exercise apparatus, stand on footpads 128, and initiate a walking, striding, or jogging motion. The weight of the user on footpad 128 may cause a force to be transmitted through roller 104, cam device 102, and movable member 112 to crank members 116A and 116B. Crank members 116A and 116B may move in unison such that every portion of movable member 112 moves in a circular pattern in which the diameter of the circular pattern equals the diameter of the crank members. As a user continues walking, roller 104 may traverse cam device 102. The combined motion of roller 104 traversing cam device 102 and movable member 112 rotating in a circular pattern may create a closed foot path in space.

Figure 26:
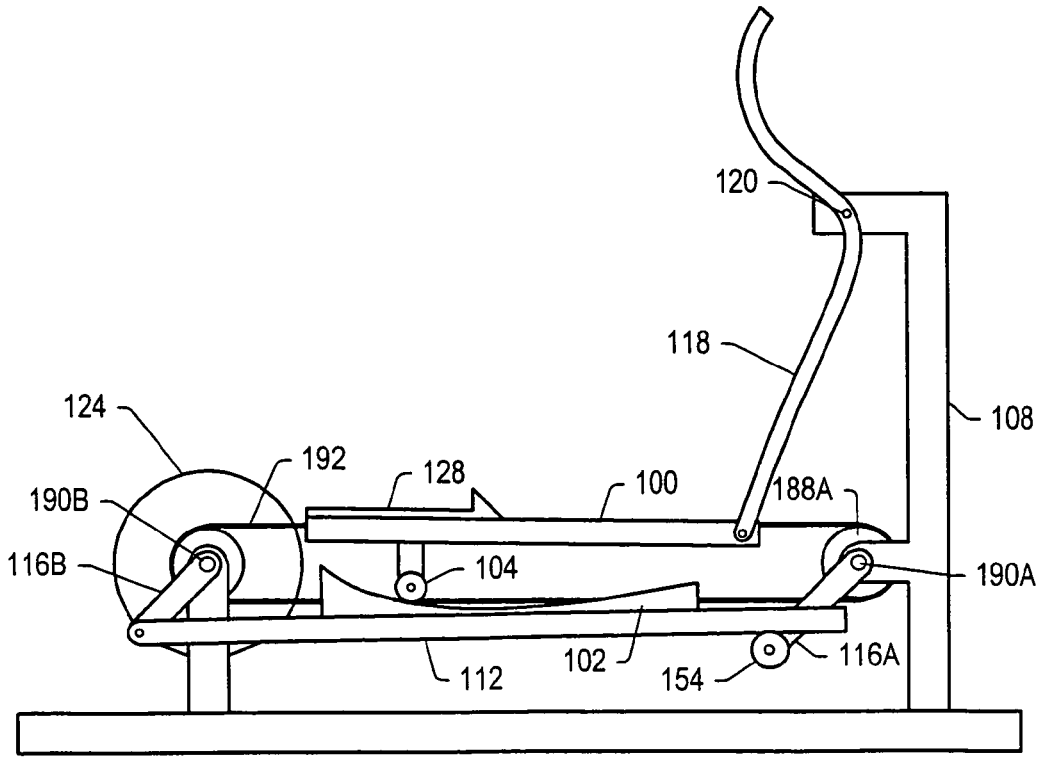
FIG. 26 depicts a schematic of an embodiment of an exercise apparatus.

In some embodiments, as depicted in FIG. 26, crank member 116A may have roller 154 that supports the front of movable member 112. Thus, crank member 116A may be out of phase with crank member 116B and may have a different diameter than crank member 116B.

Figure 27:
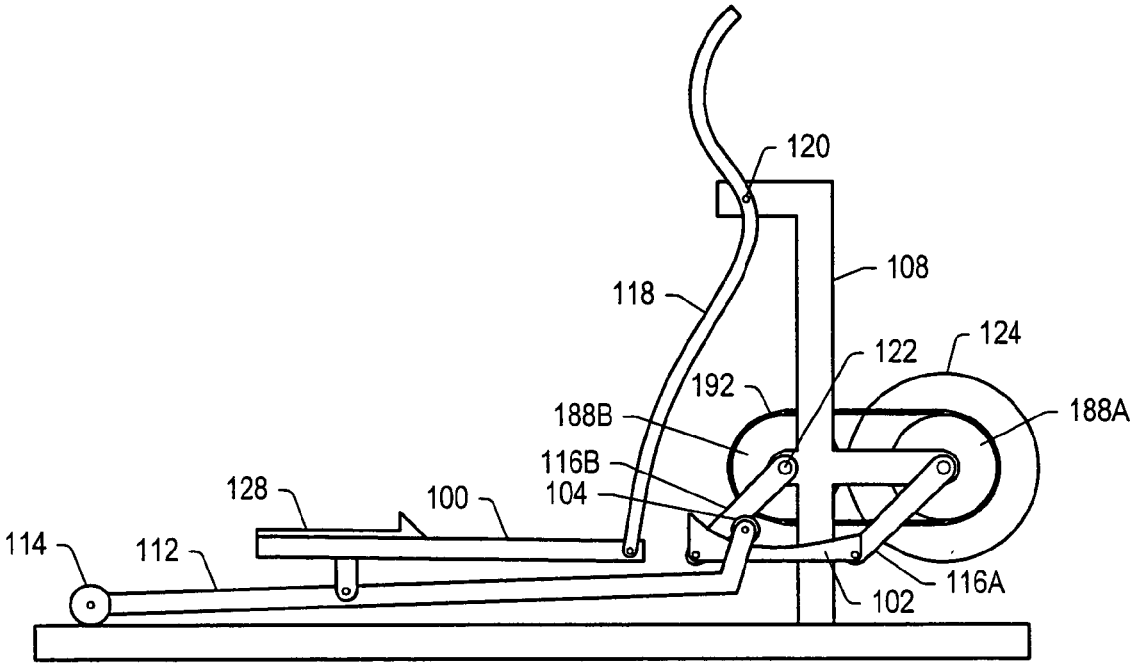
FIG. 27 depicts a schematic of an embodiment of an exercise apparatus.

FIG. 27 depicts a schematic of an embodiment of an exercise apparatus. Cam device 102 may be pivotally coupled to crank members 116A and 116B. Crank members 116A and 116B may rotate in unison by the action of chain 192 and sprockets 188A and 188B. In some embodiments, a gearbelt and gearbelt pulleys may be used instead of a chain and sprockets. In an embodiment, cam device 102 moves in a circular pattern. Roller 104 may engage cam device 102 and support the front of movable member 112. Foot member 100 may have footpad 128. Foot member 100 may be pivotally coupled at or near a middle portion of movable member 112. Foot member 100 may be pivotally coupled at one end to arm link 118.

Figure 28:
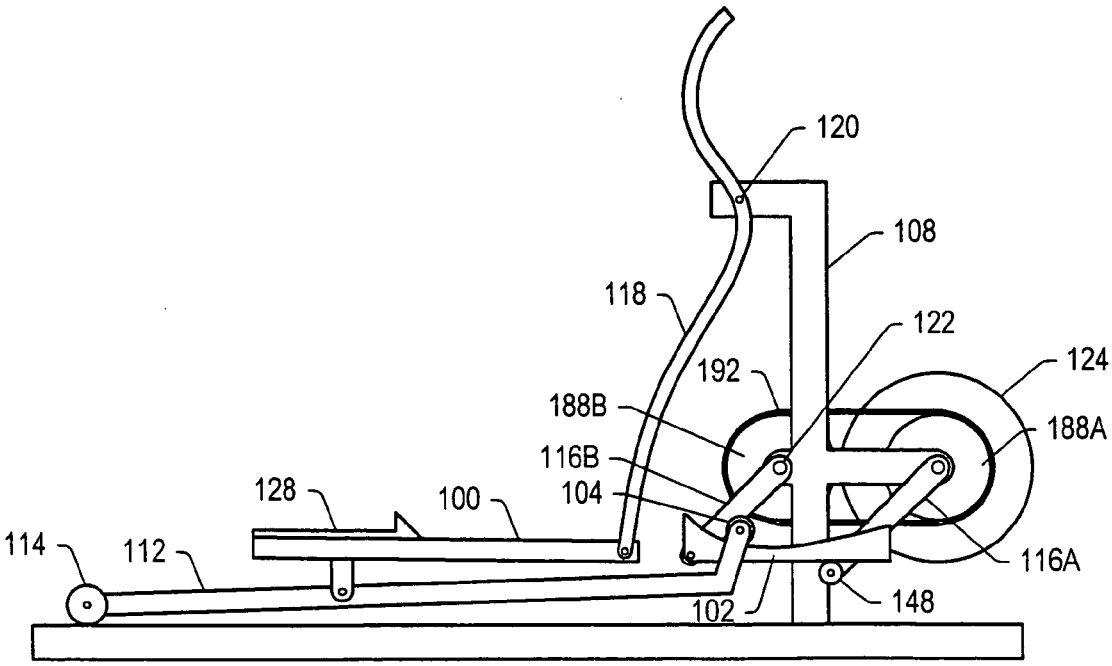
FIG. 28 depicts a schematic of an embodiment of an exercise apparatus.

FIG. 28 depicts a schematic of an embodiment of an exercise apparatus. Cam device 102 may be pivotally coupled to crank member 116B. The other end of cam device 102 may be supported by roller 148. Roller 148 may be coupled to crank member 116A. Crank member 116A may be out of phase and may have a different diameter than crank member 116B.

Figure 29:
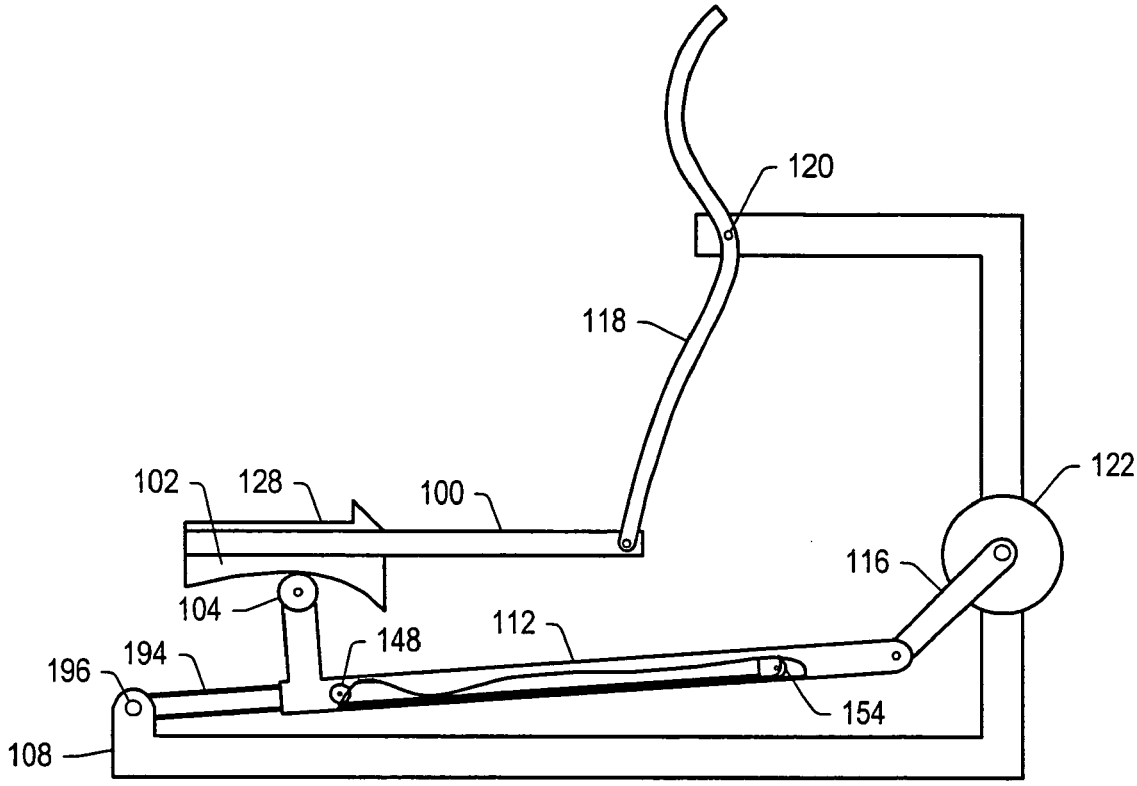
FIG. 29 depicts a schematic of an embodiment of an exercise apparatus.

In some embodiments, a telescoping member may be pivotally coupled to a frame. FIG. 29 depicts a schematic of an embodiment of an exercise apparatus. Movable member 112 may be coupled to crank member 116. Movable member 112 may be hollow. Telescoping member 194 may be pivotally coupled at point 196 to frame 108. Telescoping member 194 may telescope in and out of movable member 112. Movable member 112 may slidably engage telescoping member 194, or rollers may be used as shown in FIG. 29. Telescoping member 194 may have shapes including, but not limited to, a channel shape or an I-beam shape. Roller 148 may be coupled to movable member 112 and engage telescoping member 194. Roller 154 may be coupled to telescoping member 194 at an end of the telescoping member opposite point 196 and engage movable member 112. Rollers 148 and 154 may allow low friction telescoping action of telescoping member 194. The action of crank member 116, movable member 112, and telescoping member 194 may create a closed ovate path in space at roller 104. Roller 104 and cam device 102 may create a resistive/restoring force during use.

Figure 30:
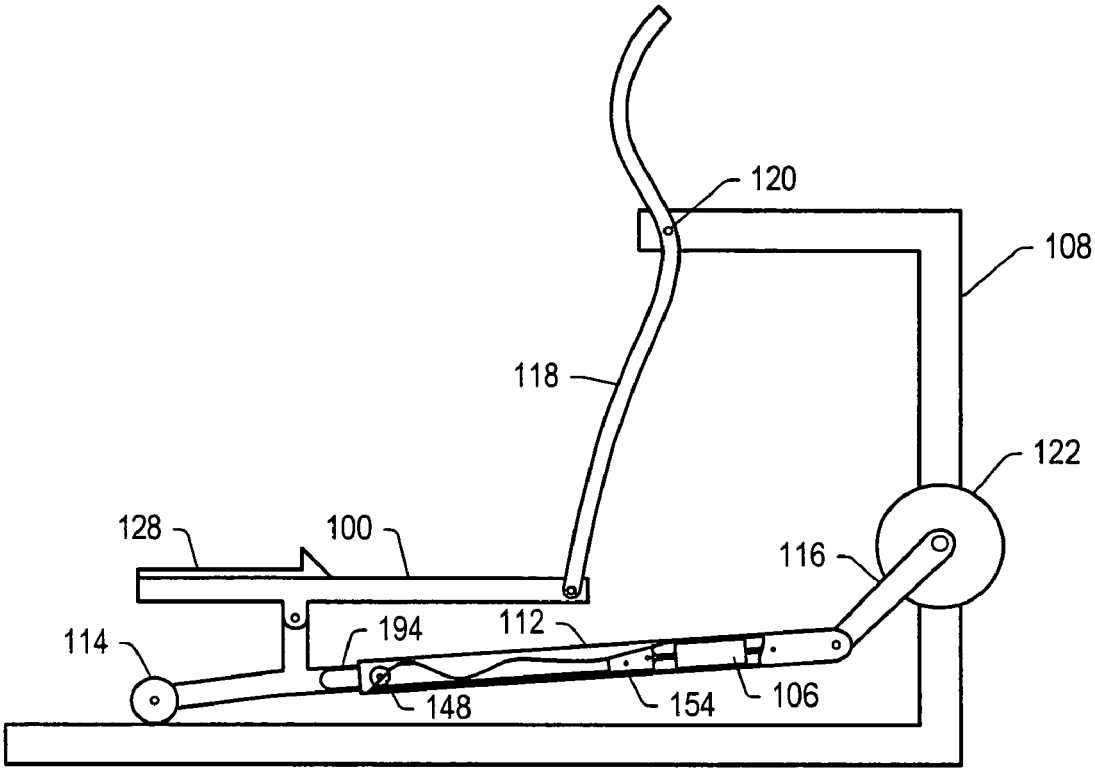
FIG. 30 depicts a schematic of an embodiment of an exercise apparatus with a spring/damper device.

In certain embodiments, a spring/damper device may be used to generate resistive/restoring forces. FIG. 30 depicts a schematic of an embodiment of an exercise apparatus with a spring/damper device. Movable member 112 may be coupled to crank member 116. Telescoping member 194 may telescope in and out of movable member 112. As shown in FIG. 29, rollers 148 and 154 may be included in the telescoping system to reduce friction. Spring/damper device 106 may be coupled (e.g., pinned) to telescoping member 194 and movable member 112. Spring/damper device 106 may include a spring only, a damper only, or a combination spring and damper. Spring/damper device 106 may provide a damping force and/or a spring force that tends to resist extension of telescoping member 194. Spring/damper device 106 may provide a restoring force to return telescoping member 194 to its nominal position relative to movable member 112. Thus, a user may increase or decrease stride length during use accordingly.

Figure 31:
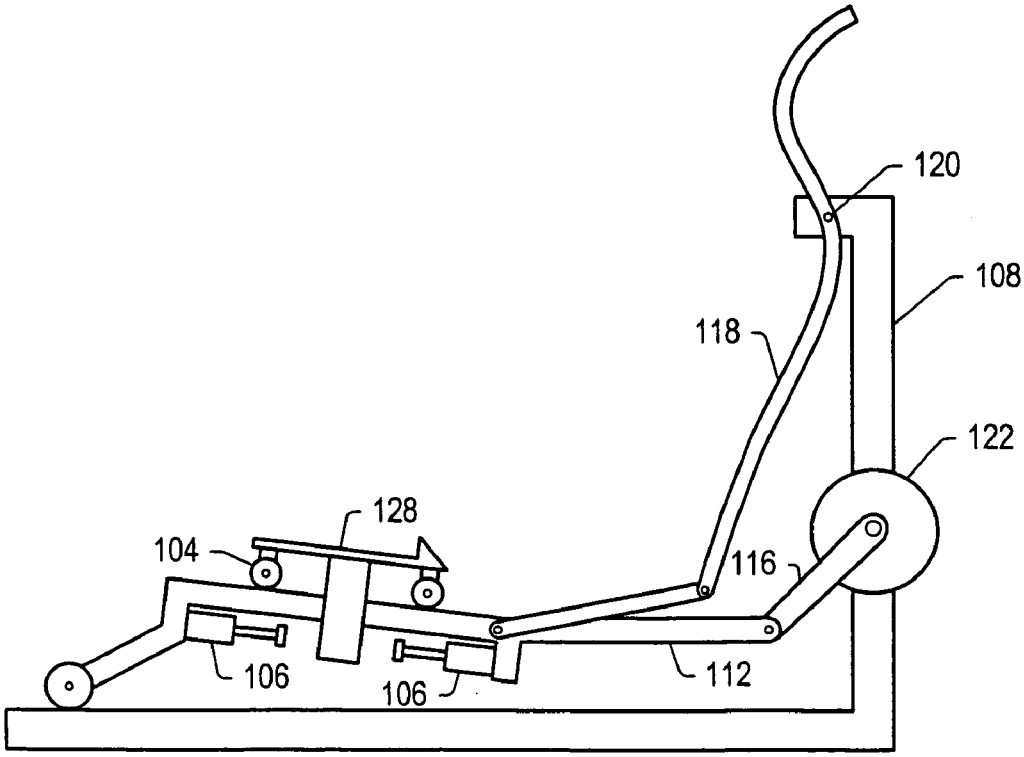
FIG. 31 depicts a schematic of an embodiment of an exercise apparatus with a spring/damper device.

FIG. 31 depicts a schematic of an embodiment of an exercise apparatus with a spring/damper device. Movable member 112 may be coupled to crank member 116. Footpad 128 may be able to translate along movable member 112 on rollers 104. In certain embodiments, footpad 128 may slide along movable member 112 to add damping and resistive forces. Spring/damper devices 106 may provide a resistive force and/or a restoring force on contact with footpad 128.

Figure 32:
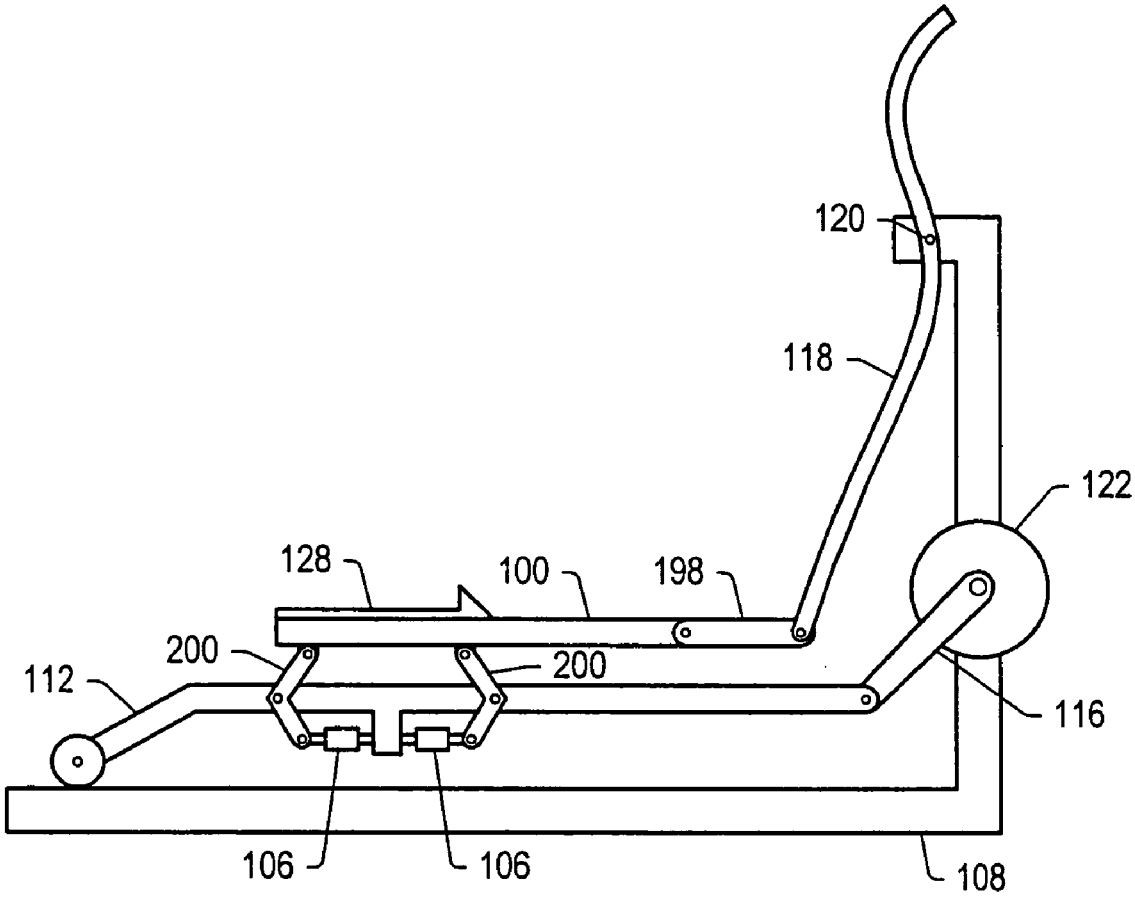
FIG. 32 depicts a schematic of an embodiment of an exercise apparatus with a spring/damper device.

FIG. 32 depicts a schematic of an embodiment of an exercise apparatus with a spring/damper device. Frame 108 may support crank member 116. Crank member 116 may engage movable member 112. Foot member 100 may be pivotally coupled at one end through coupler link 198 to arm link 118. The force resisting/restoring system may include rocker links 200. Rocker links 200 may be pivotally coupled to movable member 112 and may be pivotally coupled to foot member 100. Spring/damper devices 106 may provide a resistive and/or a restoring force though rocker links 200 to foot member 100.

Figure 33:
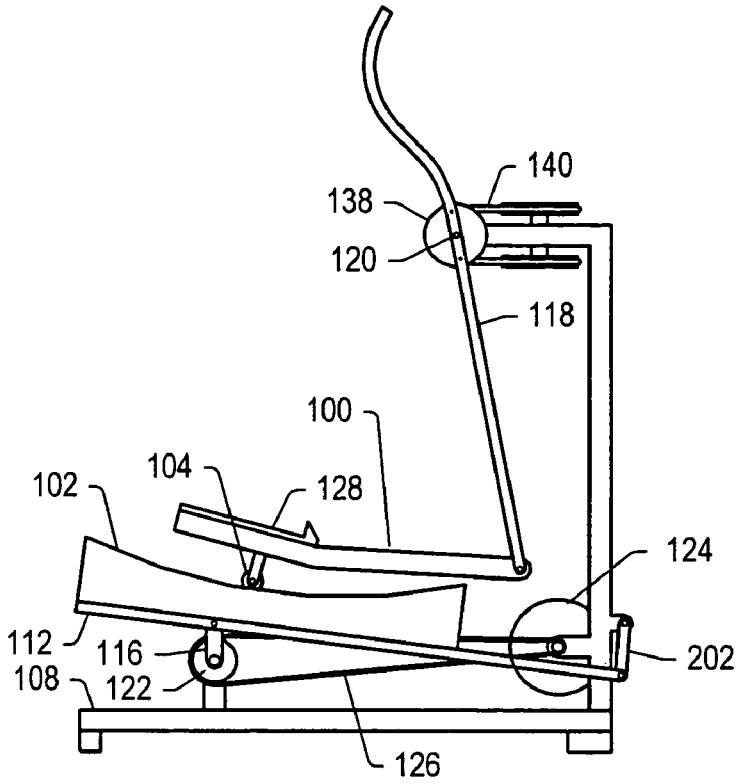
FIG. 33 depicts a schematic of an embodiment of an exercise apparatus.

FIG. 33 depicts a schematic of an embodiment of an exercise apparatus. Movable member 112 may be coupled to crank member 116. A forward portion of movable member 112 may be pivotally coupled to supporting link 202. Arm link 118 may be pivotally coupled to and supported by frame 108 at point 120. Arm link 118 may be pivotally coupled to foot member 100. Upper portion of arm link 118 may be used as a grasping member. Crank member 116 may drive pulley device 122. Pulley device 122 may drive brake/inertia device 124 through belt 126.

Foot member 100 may have footpad 128. A user of the apparatus may stand on footpad 128. Roller 104 may be coupled to foot member 100. Roller 104 may engage movable member 112. Roller 104 may be free to roll along movable member 112. Movable member 112 may be formed or fabricated to a specific shape to create certain desired operating characteristics for the apparatus. In certain embodiments, movable member 112 may include cam device 102. Cam device 102 may be formed as a part of movable member 112. Cam device 102 may have a curved profile.

Belt 140 may be a continuous loop that engages pulley 138 and a similar pulley on an opposite (symmetrical) side of the apparatus (not shown). Belt 140 may cause right side arm link 118 and right side foot member 100 to move in opposition to a left side arm link and a left side foot member.

In an embodiment, a user may ascend the exercise apparatus, stand on footpads 128, and initiate a walking, striding, or jogging motion. The weight of the user on footpad 128 may cause a force to be transmitted through roller 104 to movable member 112. This force may cause the rotation of crank member 116, pulley 122, and a brake/inertia device. As crank member 116 rotates, movable member 112 may undertake closed path motion near roller 104. Foot member 100 and movable member 112 may interact through roller 104, which is free to translate along cam device 102. The nature of the interaction and the magnitude and direction of forces transmitted through roller 104 may be controlled by the shape of cam device 102. As the user variably applies force to footpad 128, force may be transmitted through roller 104 to movable member 112 to drive crank member 116. As crank member 116 rotates, the crank member may impart a force to movable member 112, which imparts a force to foot member 100 through roller 104 and cam device 102. These forces may be more significantly imparted at the end or beginning of a step or stride by the user and assist in changing the direction of foot member 100 at the end or beginning of the step by the user. The user is able to determine and select his/her stride length because foot member 100 is not rigidly coupled to movable member 112.

Figure 34:
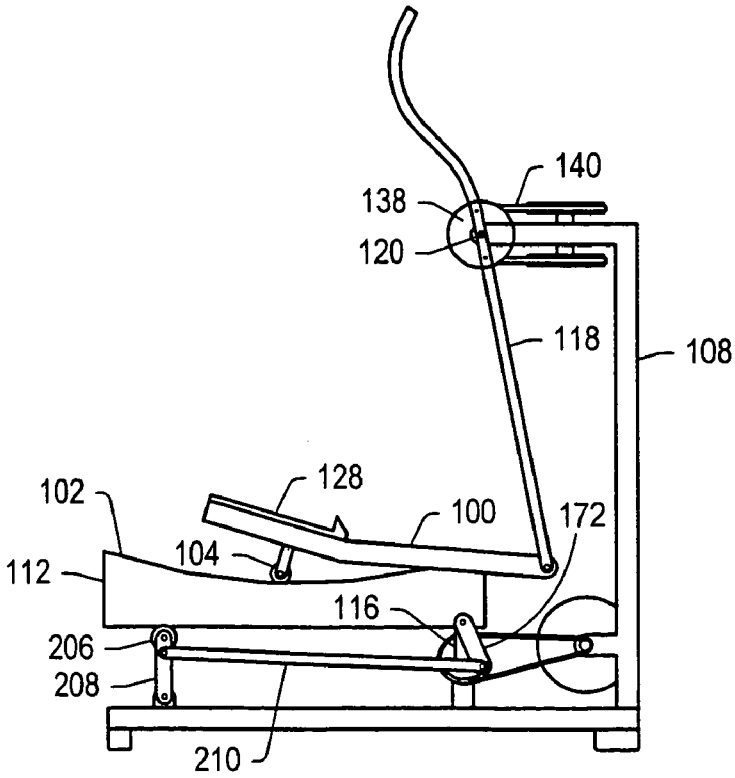
FIG. 34 depicts a schematic of an embodiment of an exercise apparatus.

FIG. 34 depicts a schematic of an embodiment of an exercise apparatus. Movable member 112 may be supported at a front end by crank member 116. Movable member 112 may be supported at a rear end by roller 206 and support link 208. Secondary crank member 172 may drive connecting link 210 so that support link 208 moves through an arcuate path during rotation of crank member 116. Rotation of crank member 116 may cause rotation of a front end of movable member 112 through a substantially circular path.

Figure 35:
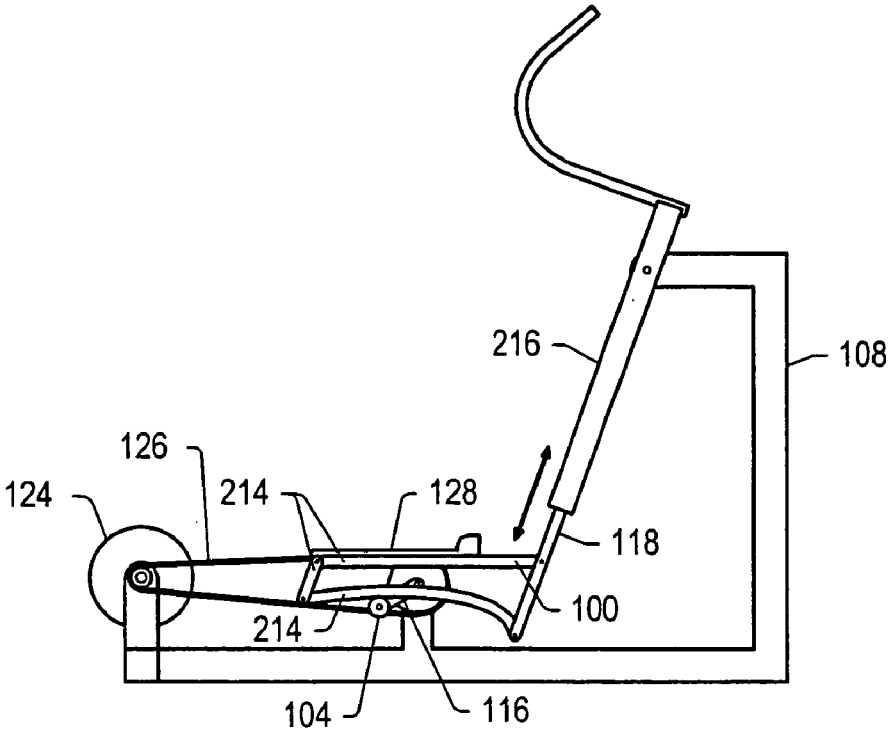
FIG. 35 depicts a schematic of an embodiment of an exercise apparatus.

FIG. 35 depicts a schematic of an embodiment of an exercise apparatus. Links 214 may be pivotally coupled to each other and to arm link 118. Links 214 and arm link 118 may form a four bar linkage system. In certain embodiments, links 214 and arm link 118 may operate in unison. A lower link of links 214 may be formed to a curved cam shape. The lower link may engage roller 104. Roller 104 may be coupled to an end of crank member 116. During use of the apparatus, links 214 and arm link 118 may articulate and orient a foot of a user and the cam shape of the lower link. The lengths and/or positions of the pivotal coupling points of links 214 may be controlled by a designer of the apparatus to create a desired articulation pattern. During use of the apparatus, arm link 118 may telescope in and out of link 216. Link 216 may be pivotally coupled to frame 108. A handle portion may be coupled to link 216. The handle portion may move in an arcuate, reciprocating path.

Figure 36:
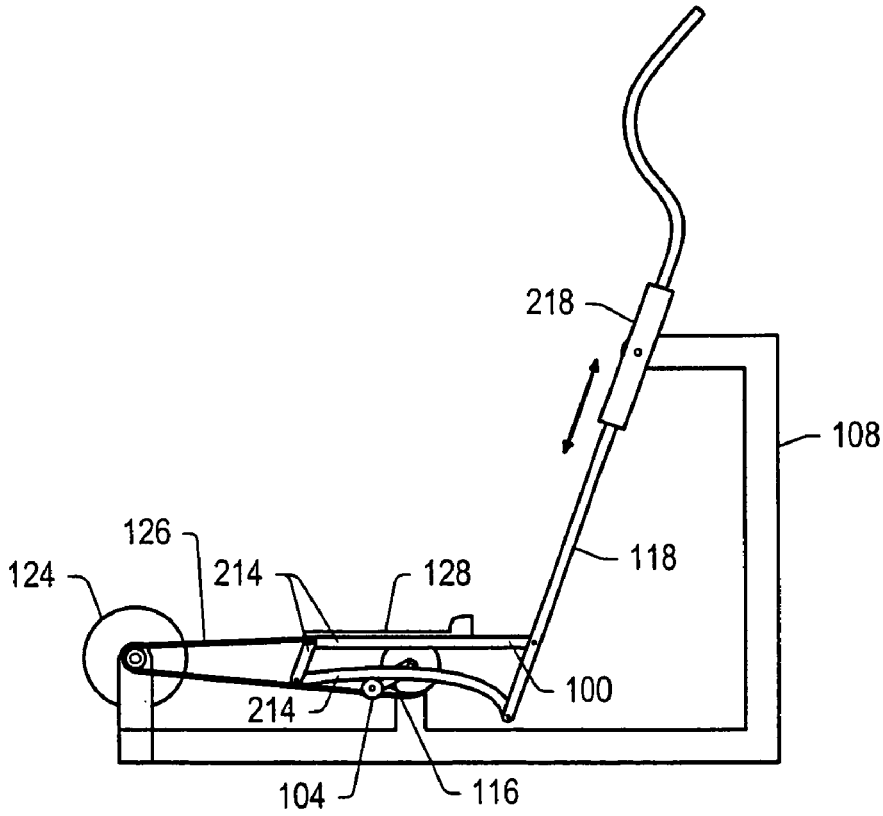
FIG. 36 depicts a schematic of an embodiment of an exercise apparatus.

FIG. 36 depicts a schematic of an embodiment of an exercise apparatus. The linkage system in the embodiment shown in FIG. 36 operates similarly to the linkage system in the embodiment shown in FIG. 35. Arm link 118 may slidably engage member 218. An upper portion of arm link 118 (e.g., an upper handle portion) may extend through member 218. The upper portion of arm link 118 may move with both horizontal and vertical displacement. The upper portion of arm link 118 may move through a closed path.

Figure 37A:
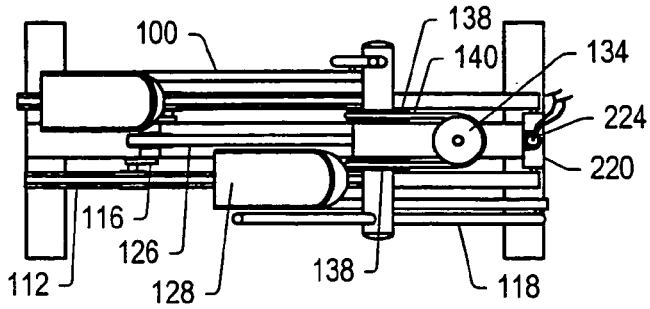
FIG. 37A depicts a top view of an embodiment of an exercise apparatus.
Figure 37:
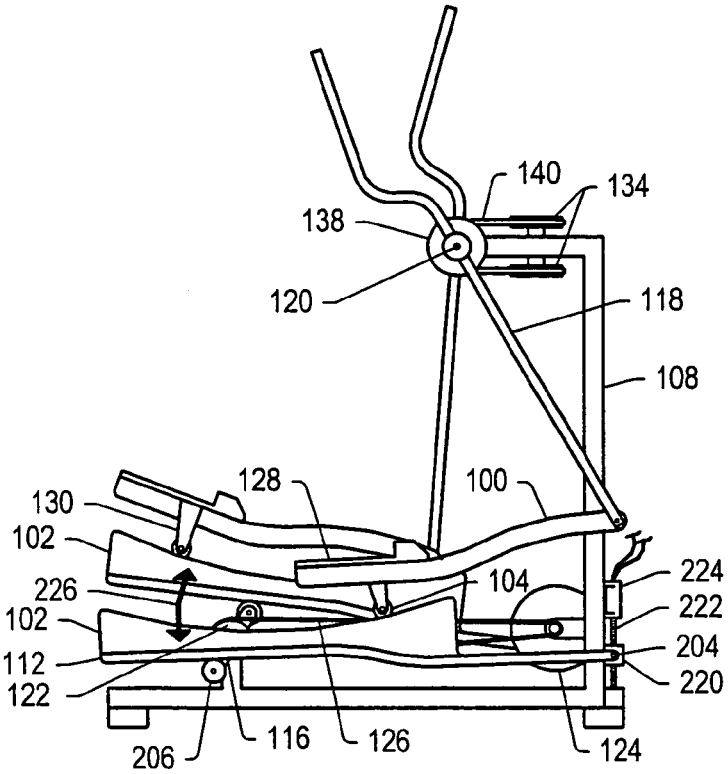
FIG. 37 depicts a side view of an embodiment of an exercise apparatus.

In some embodiments, an exercise apparatus may provide a curvilinear path of motion. FIG. 37 depicts a side view of an embodiment of an exercise apparatus. FIG. 37A depicts a top view of an embodiment of the exercise apparatus depicted in FIG. 37. Frame 108 may include a basic supporting framework and an upper stalk. Frame 108 may be any structure that provides support for one or more components of an exercise apparatus. In certain embodiments, all or a portion of frame 108 may remain substantially stationary during use. For example, all or a portion of frame 108 may remain substantially stationary relative to a floor on which the exercise apparatus is used.

In FIG. 37, both right and left sides of the linkage system are shown. The right and left sides of the linkage system may be used for the right and left feet of a user, correspondingly. The right and left sides may be mirror images along a vertical plane oriented along the center of the machine as viewed from above, as shown in FIG. 37A.

Left and right movable members 112 may be pivotally coupled at point 204 to actuator block 220. Roller 206 may be coupled to an end of crank member 116. Rotation of crank member 116 may cause the rising and falling motion of movable member 112 in an arcuate pattern shown by arrow 226. Arm links 118 may be pivotally coupled to and supported by frame 108 at point 120. Arm links 118 may be pivotally coupled to foot members 100. Arm links 118 may be designed so that the upper portions can be used as grasping members (e.g., handles).

Crank members 116 may drive pulley device 122, which in turn may drive brake/inertia device 124 using belt 126.

Foot member 100 may have footpads 128 or any other surface on which a user may stand. Footpad 128 may be any surface on which a user's foot resides during use of an exercise apparatus (e.g., the footpad may be a foot pedal). Roller 104 may be coupled to foot member 100 by bracket 130. Roller 104 may engage movable member 112 at cam device 102. Cam device 102 may be formed to a specific shape to provide desired operating characteristics.

Cam device 102 may have a long length cam surface compared to the length of crank member 116. In certain embodiments, cam device 102 may have a cam surface with a length that exceeds a crank diameter of the crank system. The crank radius of the crank system is generally the length of one crank member 116. Thus, the crank diameter is twice the length of one crank member 116. In some embodiments, the length of the cam surface of cam device 102 is at least about 1.5 times the crank diameter of the crank system. In some embodiments, the length of the cam surface of cam device 102 is at least about 2 times the crank diameter of the crank system. The length of the cam surface of cam device 102 is the path length along the cam surface (e.g., the length along a curved surface of the cam device). The long length of the cam surface compared to the crank diameter of the crank system may provide a long stride length on a relatively compact exercise apparatus.

The forward portion of movable member 112 is shown to be straight in FIG. 37. Movable member 112 may, however, be curved and/or include a bend. In certain embodiments, movable member 112 is made of a solid or unitary construction. In some embodiments, movable member 112 may include multiple components coupled or fastened to achieve a desired performance. In certain embodiments, cam device 102 and movable member 112 may be incorporated in a single unit such as a bent or curved tube or bar. Similarly, foot members 100 and arm links 118 may be straight, bent, or curved. Foot members 100 and arm links 118 may be unitary or may include multiple components.

In an embodiment, a user ascends the exercise apparatus, stands on footpads 128 and initiates a walking, striding, or jogging motion. The weight of the user on footpads 128 combined with motion of the footpads and foot members 100 causes a force to be transmitted to movable members 112 through roller 104 and cam device 102. This force in turn causes the rotation of crank members 116, pulley device 122, and brake/inertia device 124. As crank members 116 rotate, movable members 112 undertake a rising and falling motion in an arcuate pattern. In an embodiment, foot member 100 and reciprocating member 112 interact through roller 104, which is free to translate relative to movable member 112 at cam device 102. The nature of the interaction and the magnitude and direction of the forces transmitted through roller 104 may be controlled by the shape and/or orientation of cam device 102.

Figure 38:
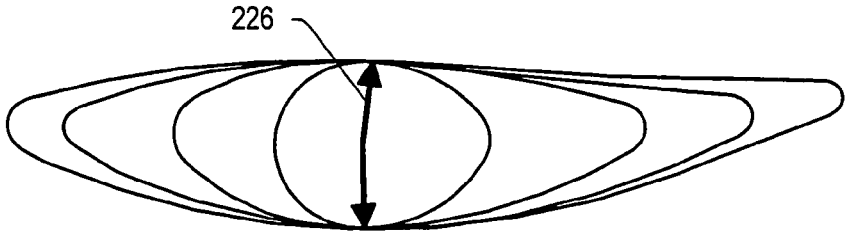
FIG. 38 depicts representations of possible paths of motion in an exercise apparatus.

The rising and falling motion of the movable members 112 may induce a striding pattern. As shown in FIG. 37, when crank member 116 is in a downward position, movable member 112 supported by roller 206 has a generally rearward slope toward the back of the machine. This rearward slope induces foot member 100 to move rearward as the user applies force through the foot member. When crank member 116 is an upward position, movable member 112 supported by roller 206 on that crank member has a generally forward slope toward the front of the machine. This forward slope induces foot member 100 to move forward. Therefore, the rising and falling motion of movable members 112 may induce a forward and rearward motion in foot members 100. This forward and rearward motion in foot members 100 may allow for various paths of motion related to the arcuate pattern represented by arrow 226. Examples of these various paths of motion relative to the arcuate pattern represented by arrow 226 are shown in FIG. 38. In certain embodiments, an exercise apparatus (e.g., the embodiment depicted in FIG. 37) may provide paths of motion that become more oblong in shape as the stride length increases, as shown in FIG. 38.

The right and left side linkage systems (e.g., foot members 100, arm links 118, and/or reciprocating members 112) may be cross coupled so that they move in a direct and constant opposition to one another. Link pulleys 138 may be rigidly coupled to and rotate in unison with arm links 118. Idler pulleys 134 may be mounted to frame 108 and may rotate freely. Coupling belt or cable 140 may be a continuous loop that wraps around link pulleys 138, both right and left sides, and idler pulleys 134, both upper and lower. Coupling belt or cable 140 may be coupled to link pulleys 138 such that there is limited or no slip in the coupling belt or cable. The coupling can be made by commonly available fasteners, or a cogged belt and pulley may be used. In some embodiments, sections of roller chain engaging sprockets, rather than pulleys, may be used. The belt and pulley system, which includes link pulleys 138, idler pulleys 134, and/or coupling belt 140, may serve to cross couple the right side and left side linkage systems so that forward motion of the right side linkage system causes rearward motion of the left side linkage system, and vice versa.

The intensity of exercise for a user may be varied by altering the geometry of the linkage system. For example, actuator block 220 may be repositioned higher or lower by the action of rotating motor 224 and leadscrew 222. By raising actuator block 220, the user must step higher at the beginning of the stride. This higher step effectively increases the perceived striding or climbing angle and increases the intensity of the exercise. Rotating motor 224 may be controlled by a user interface and/or control circuitry.

Figure 39:
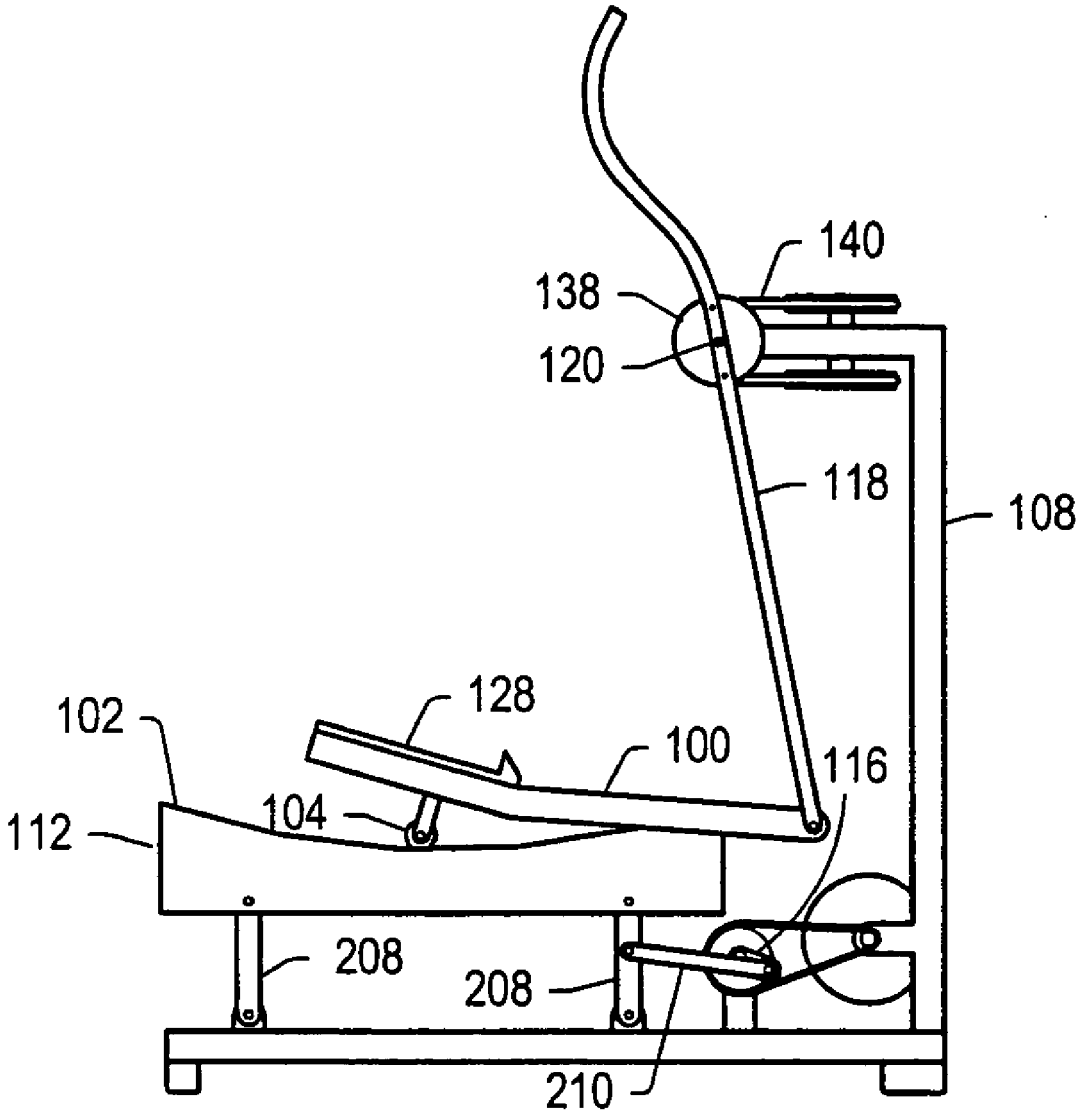
FIG. 39 depicts a schematic of an embodiment of an exercise apparatus.

FIG. 39 depicts a schematic of an embodiment of an exercise apparatus. Movable member 112 may be supported at a front end and a rear end by support links 208. Connecting link 210 may couple crank member 116 to forward support link 208. Rotation of crank member 116 may cause movable member 116 to rise and fall in an arcuate path.

Figure 40:
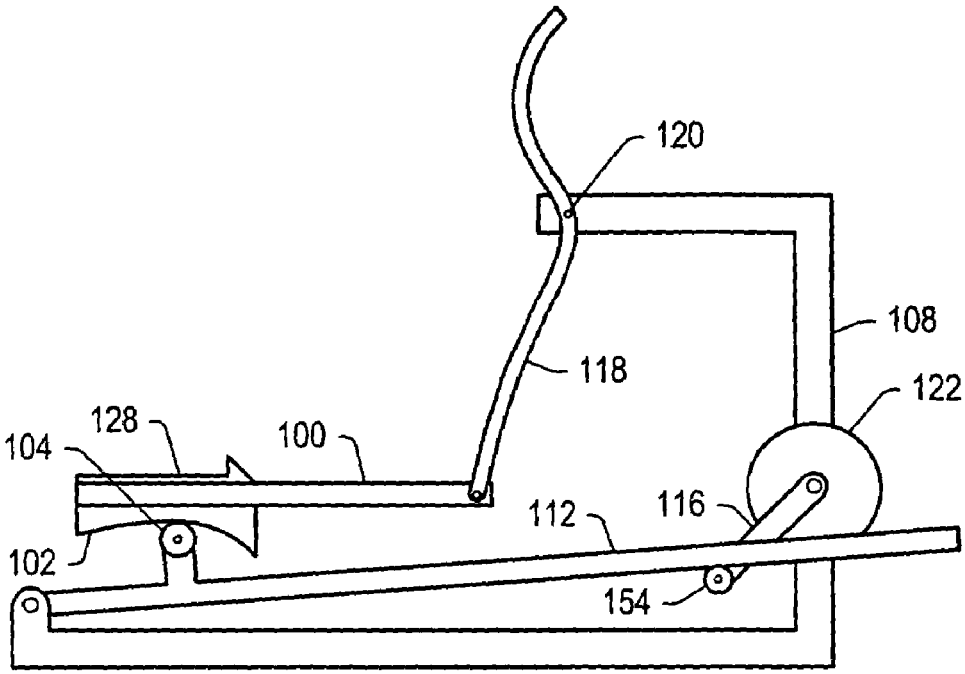
FIG. 40 depicts a schematic of an embodiment of an exercise apparatus.

FIG. 40 depicts a schematic of an embodiment of an exercise apparatus. Movable member 112 may be supported by roller 154. Roller 154 may be coupled (e.g., mounted) to an end of crank member 116. Rotation of crank member 116 may cause movable member 112 to rise and fall in an arcuate path. Roller 104 may also rise and fall in an arcuate path.

Figure 41:
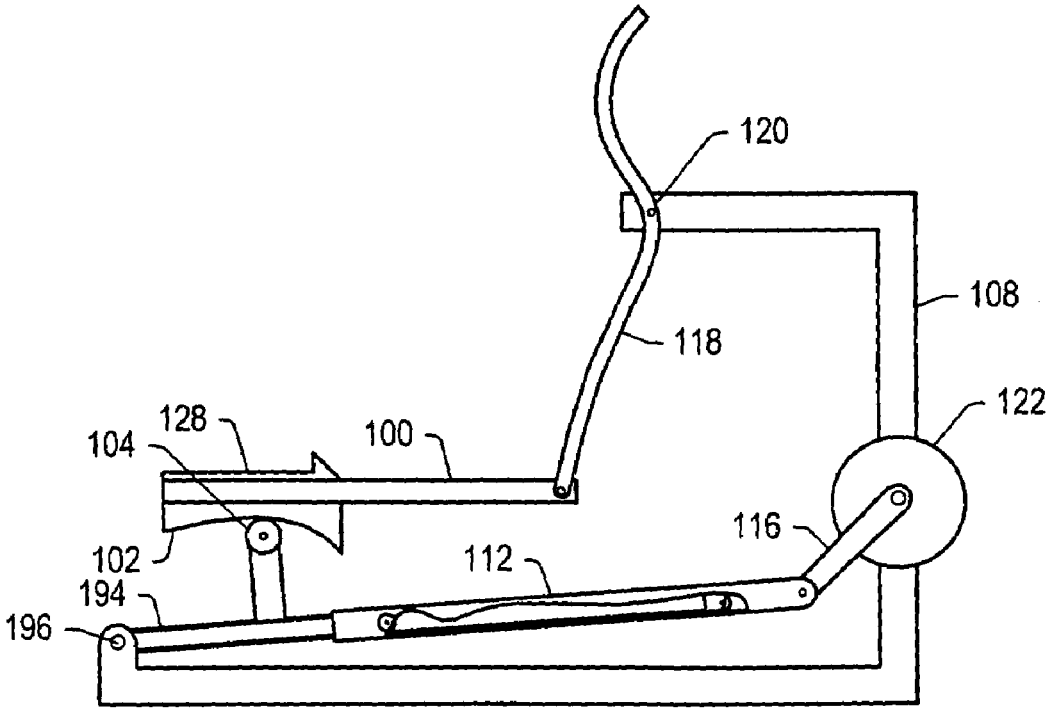
FIG. 41 depicts a schematic of an embodiment of an exercise apparatus.

FIG. 41 depicts a schematic of an embodiment of an exercise apparatus. Movable member 112 may be coupled to telescoping member 194. Telescoping member 194 may move in and out of movable member 112. Rotation of crank member 116 may cause telescoping member 194 to rise and fall in an arcuate path. Roller 104 may also rise and fall in an arcuate path.

Figure 42:
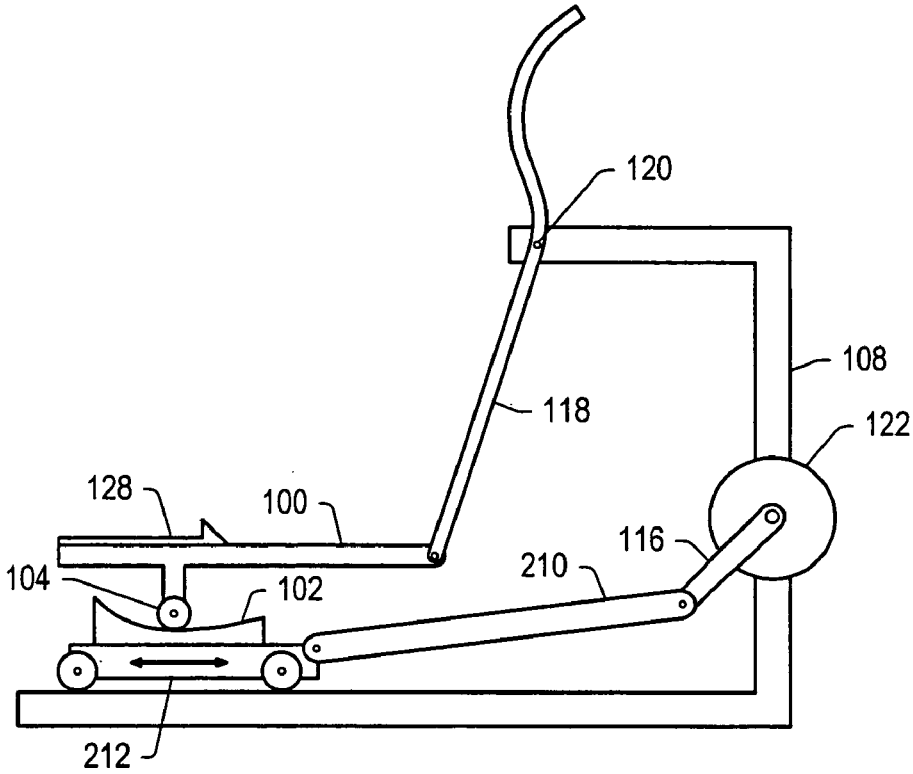
FIG. 42 depicts a schematic of an embodiment of an exercise apparatus.

In some embodiments, an exercise apparatus may provide relatively linear path of motion for a user. FIG. 42 depicts a schematic of an embodiment of an exercise apparatus. Crank member 116 may be coupled to connecting link 210. Rotation of crank member 116 may cause reciprocation of traveling member 212. Reciprocation of traveling member 212 may be horizontal reciprocation. Cam device 102 may engage roller 104. Cam device 102 may move along with traveling member 212.

Figure 43:
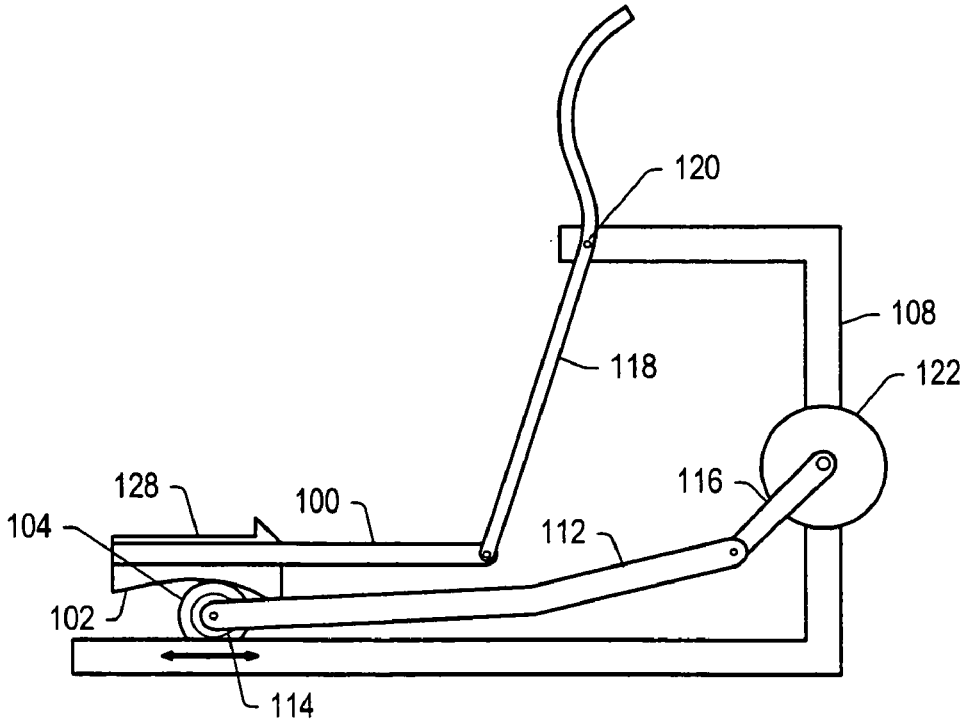
FIG. 43 depicts a schematic of an embodiment of an exercise apparatus.

FIG. 43 depicts a schematic of an embodiment of an exercise apparatus. Crank member 116 may be coupled to movable member 112. Rotation of crank member 116 may cause reciprocation (e.g., horizontal reciprocation) of movable member 112 at roller 104 and wheel 114. Roller 104 may be mounted coaxially with wheel 114. Roller 104 may move in a reciprocating pattern (e.g., a horizontal reciprocating pattern). Cam device 102 may engage roller 104.

In this patent, certain U.S. patents, U.S. patent applications, and other materials (e.g., articles) have been incorporated by reference. The text of such U.S. patents, U.S. patent applications, and other materials is, however, only incorporated by reference to the extent that no conflict exists between such text and the other statements and drawings set forth herein. In the event of such conflict, then any such conflicting text in such incorporated by reference U.S. patents, U.S. patent applications, and other materials is specifically not incorporated by reference in this patent.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

The invention claimed is:

1. A stationary exercise apparatus comprising:

a frame;

a crank system coupled to the frame, wherein the crank system comprises a left crank and a right crank;

a left arm link coupled to the frame;

a right arm link coupled to the frame;

a left foot member configured to travel in multiple paths, said left foot member having a forward end and a rearward end wherein the left foot member is coupled at its forward end to the left arm link;

a left cam having a forward end and a rearward end, said left cam coupled to the left crank and coupled to the left foot member proximal the rearward end of the left foot member so that at least a portion of a user's left foot is behind the forward end of said left cam and wherein the left foot member and the left arm link are configured to allow a substantially instantaneous variable stride of the left foot;

a right foot member configured to travel in multiple paths, said right foot member having a forward end and a rearward end wherein the right foot member is coupled at its forward end to the right arm link; and a right cam having a forward end and a rearward end, said left cam coupled to the left crank and coupled to the right foot member proximal the rearward end of the right foot member so that at least a portion of a user's right foot is behind the forward end of said right cam and wherein the right foot member and the right arm link are configured to allow a substantially instantaneous variable stride of the right foot, wherein the left foot member and the right foot member are cross coupled so that the left foot member may move in opposition to the right foot member, and wherein the apparatus is configured such that the feet of the user may travel in a substantially closed path.

2. The apparatus of claim 1 wherein the left and right cams face substantially downwardly.

3. The apparatus of claim 1 wherein the left and right cams face substantially upwardly.

4. The apparatus of claim 1 wherein the feet of the user may travel in a substantially closed elliptical path.

5. The apparatus of claim 1 wherein the feet of the user may travel in a closed orbital path.

6. The apparatus of claim 1 further comprising a brake/inertia device coupled to the crank system.

7. The apparatus of claim 6 wherein the brake/inertia device is coupled to a portion of the frame in front of the user.

8. The apparatus of claim 6 wherein the brake/inertia device is coupled to a portion of the frame behind the user.

9. The apparatus of claim 6 further comprising a housing, wherein the housing encloses at least a portion of the brake/inertia device.

10. The apparatus of claim 1 wherein the left and right cams are nonsymmetrical.

11. The apparatus of claim 1 wherein the left and right cams are symmetrical.

12. The apparatus of claim 1 wherein the length of each left and right cam is at least two times the length of each left or right crank.

13. The apparatus of claim 1 wherein the crank system is coupled to the frame at a rearward portion of the frame.

14. The apparatus of claim 1 wherein the left cam is directly attached to the left foot member and the right cam is directly attached to the right foot member.

15. The apparatus of claim 1 wherein the left cam is coupled to the left crank through a left roller and the right cam is coupled to the right crank through a right roller.

16. A stationary exercise apparatus, comprising:

a frame;

a crank system coupled to the frame;

a left foot member having a forward end and a rearward end, said left foot member comprising a left footpad located proximal the rearward end of said left foot member;

a right foot member having a forward end and a rearward end, said right foot member comprising a right footpad located proximal the rearward end of said right foot member;

a left cam coupled to the crank system and to the left foot member so that at least a portion of said left cam is located under the left foot pad; and a right cam coupled to the crank system and to the right foot member so that at least a portion of said right cam is located under the right foot pad, and wherein the left foot member and the right foot member are cross coupled so that the left foot member moves in opposition to the right foot member, wherein the apparatus is configured such that the feet of the user impart forces to the left and right foot members in cooperation with the left and right cams to vary the stride substantially instantaneously, and wherein the apparatus is configured such that the feet of the user may travel in a substantially closed path during use of the apparatus.

17. The apparatus of claim 16 wherein the left and right cams face substantially downwardly.

18. The apparatus of claim 16 wherein the left and right cams face substantially upwardly.

19. The apparatus of claim 16 wherein the crank system comprises a pulley.

20. The apparatus of claim 19 where in the crank system comprises a left crank and a right crank coupled to the pulley.

21. The apparatus of claim 16 wherein the feet of the user may travel in a substantially closed elliptical path.

22. The apparatus of claim 16 wherein the feet of the user may travel in a closed orbital path.

23. The apparatus of claim 16 further comprising a brake/inertia device coupled to the crank system.

24. The apparatus of claim 23 further comprising a housing, wherein the housing encloses at least a portion of the brake/inertia device.

25. The apparatus of claim 16 wherein the left and right cams are nonsymmetrical.

26. The apparatus of claim 16 wherein the left and right cams are symmetrical.

27. The apparatus of claim 16 wherein the crank system is coupled to the frame at a rearward portion of the frame.

28. The apparatus of claim 16 wherein the left cam is directly attached to the left foot member and the right cam is directly attached to the right foot member.

29. A stationary exercise apparatus, comprising:

a frame;

a crank system coupled to the frame, wherein the crank system comprises a left side and a right side;

a left pivotal linkage assembly coupled to the frame, said left pivotal linkage assembly comprising a left foot member and a left cam system, said left foot member comprising a left foot pad having forward and rearward ends, said left cam system comprising a left cam and a left cam follower wherein at least a portion of the left cam is ahead of the rearward end and behind the forward end of the left footpad at some time during use; and a right pivotal linkage assembly coupled to the frame, said right pivotal linkage assembly comprising a right foot member and a right cam system, said right foot member comprising a right foot pad having forward and rearward ends, said right cam system comprising a right cam and a right cam follower wherein at least a portion of the right cam is ahead of the rearward end and behind the forward end of the right footpad at some time during use, wherein the left pivotal linkage assembly is coupled through the left cam system to the left side of the crank system and the right pivotal linkage assembly is coupled through the right cam system to the right side of the crank system so that forces applied by the user's feet to the left and right foot pads may cause rotation of the crank system and allow substantially instantaneous variable stride, wherein the left pivotal linkage assembly and the right pivotal linkage assembly are cross coupled so that the left foot pad may move in opposition to the right foot pad, and wherein the apparatus is configured such that the feet of the user may travel in a substantially closed path.

30. The apparatus of claim 29 wherein the left and right cams face substantially downwardly.

31. The apparatus of claim 29 wherein the left and right cams face substantially upwardly.

32. The apparatus of claim 29 wherein the crank system comprises a pulley.

33. The apparatus of claim 32 where in the crank system comprises a left crank and a right crank coupled to the pulley.

34. The apparatus of claim 29 wherein the feet of the user may travel in a substantially closed elliptical path.

35. The apparatus of claim 29 wherein the feet of the user may travel in a closed orbital path.

36. The apparatus of claim 29 further comprising a brake/inertia device coupled to the crank system.

37. The apparatus of claim 36 further comprising a housing, wherein the housing encloses at least a portion of the brake/inertia device.

38. The apparatus of claim 29, wherein the left and right foot members and the left and right cam systems are configured to provide a force that restores the users feet to a substantially neutral position during use of the apparatus.

39. The apparatus of claim 29 wherein the crank system is coupled to the frame at a rearward portion of the frame.

40. The apparatus of claim 29 wherein the left cam is directly attached to the left foot member and the right cam is directly attached to the right foot member.

41. The apparatus of claim 29 wherein at least a portion of the crank system is located under at least a portion of the left and right foot pads.

* * * * *

UNITED STATES PATENT AND TRADEMARK OFFICE

CERTIFICATE OF CORRECTION

PATENT NO. : 7,179,201 B2
APPLICATION NO. : 10/862291
DATED : February 20, 2007
INVENTOR(S) : Robert E. Rodgers Jr.

It is certified that error appears in the above-identified patent and that said Letters Patent is hereby corrected as shown below:

In the Claims:

Column 22, line 34, delete that portion of the sentence beginning with "left cam coupled to the left crank" and insert --right cam coupled to the right crank--

Signed and Sealed this

Twenty-ninth Day of April, 2008

JON W. DUDAS
*Director of the United States Patent and Trademark Office*